US011411354B2

(12) United States Patent
Little

(10) Patent No.: US 11,411,354 B2
(45) Date of Patent: Aug. 9, 2022

(54) ELECTRICAL CONNECTOR ASSEMBLY WITH A PAIR OF DIFFERENTIAL TERMINALS

(71) Applicants: FOXCONN (KUNSHAN) COMPUTER CONNECTOR CO., LTD., Kunshan (CN); FOXCONN INTERCONNECT TECHNOLOGY LIMITED, Grand Cayman (KY)

(72) Inventor: Terrance F. Little, Fullerton, CA (US)

(73) Assignees: FOXCONN (KUNSHAN) COMPUTER CONNECTOR CO., LTD., Kunshan (CN); FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 17/117,563

(22) Filed: Dec. 10, 2020

(65) Prior Publication Data

US 2021/0184403 A1 Jun. 17, 2021

Related U.S. Application Data

(60) Provisional application No. 62/946,945, filed on Dec. 11, 2019.

(51) Int. Cl.

| | |
|---|---|
| ***H01R 13/6582*** | (2011.01) |
| ***H01R 13/11*** | (2006.01) |
| ***H01R 13/502*** | (2006.01) |
| ***H01R 24/40*** | (2011.01) |
| ***H01R 13/24*** | (2006.01) |

(Continued)

(52) U.S. Cl.

CPC ..... *H01R 13/6582* (2013.01); *H01R 12/721* (2013.01); *H01R 12/724* (2013.01); *H01R 12/79* (2013.01); *H01R 13/11* (2013.01); *H01R 13/24* (2013.01); *H01R 13/424* (2013.01); *H01R 13/502* (2013.01); *H01R 13/6581* (2013.01);

(Continued)

(58) Field of Classification Search

CPC .... H01R 13/6582; H01R 13/11; H01R 13/24; H01R 13/502; H01R 24/40

USPC ..... 439/607.01

See application file for complete search history.

(56) References Cited

U.S. PATENT DOCUMENTS 5,791,939 A * 8/1998 Tanigawa ..... H01R 9/0518 439/607.01

6,099,352 A * 8/2000 Yamaguchi ..... H01R 13/6592 439/607.5

(Continued)

*Primary Examiner* — Peter G Leigh

(74) *Attorney, Agent, or Firm* — Ming Chieh Chang; Wei Te Chung

(57) ABSTRACT

A cable connector includes an insulative main housing having a front mating portion defining a capsular tube, and a rear holding portion with a sleeve; an insulative contact housing with a pair of cable contacts received therein and a metallic EMI shell covering an exterior of the contact housing; a cable mechanically and electrically connected to the cable contact. The contact housing with the associated cable contacts and the EMI shell is inserted into the insulative main housing from a rear side of the insulative main housing wherein the contact housing is received within the front mating portion and the cable is received within the sleeve. The receptacle connector includes a metallic housing, an insulative housing, a pair of receptacle contacts insert-molded within the insulative housing and an insulative cover enclosing the metallic housing.

11 Claims, 36 Drawing Sheets

(51) Int. Cl.

| | |
|---|---|
| ***H01R 12/72*** | (2011.01) |
| ***H01R 12/79*** | (2011.01) |
| ***H01R 13/424*** | (2006.01) |
| ***H01R 13/6581*** | (2011.01) |
| ***H01R 31/06*** | (2006.01) |
| *H01R 12/77* | (2011.01) |

(52) U.S. Cl.
CPC ..... *H01R 24/40* (2013.01); *H01R 31/06* (2013.01); *H01R 12/77* (2013.01)

(56) References Cited

U.S. PATENT DOCUMENTS

| | | | | |
|---|---|---|---|---|
| 6,234,840 | B1 * | 5/2001 | Nakata | H01R 13/6593 439/607.01 |
| 6,905,364 | B2 | 6/2005 | Swantner et al. | |
| 9,905,944 | B2 * | 2/2018 | Little | H01R 13/65918 |
| 10,218,121 | B2 * | 2/2019 | Little | G02B 6/4293 |
| 2019/0372273 | A1 * | 12/2019 | Zhao | H01R 13/6585 |
| 2020/0119495 | A1 | 4/2020 | Bredbeck et al. | |

* cited by examiner

300′

100′

ELECTRICAL CONNECTOR ASSEMBLY WITH A PAIR OF DIFFERENTIAL TERMINALS

CROSS REFERENCE TO RELATED APPLICATIONS

This application claims the benefit of, priority to, U.S. Provisional Patent Application No. 62/946,945 filed Dec. 11, 2019, the contents of which are incorporated entirely herein by reference

BACKGROUND OF THE DISCLOSURE

1. Field of the Disclosure

The present disclosure relates to an electrical assembly with a pair of differential contacts, which is adapted for high RF signal transmission.

2. Description of Related Arts

US Patent publication No. US20200119495A1 discloses a contact element for a high RF connector. The contact element have an at least partially electrically conductive housing for connection to an earth conductor of an electrical cable, and at least one inner conductor part for connection to at least one signal lead of the electrical cable. There are at least two resilient tongues in the contact region of the housing. The resilient tongues are each secured movably at a first, free end and immovably at a second end. It seems that the contact has a complex structure.

An improved connector assembly is desired.

SUMMARY OF THE DISCLOSURE

An object of the invention is to provide an electrical connector assembly comprising a cable connector and a receptacle connector. The cable connector comprises an insulative main housing having a front mating portion defining a capsular tube, and a rear holding portion with a sleeve; an insulative contact housing with a pair of cable contacts received therein and a metallic EMI shell covering an exterior of the contact housing; a cable mechanically and electrically connected to the cable contact. The contact housing with the associated cable contacts and the EMI shell is inserted into the insulative main housing from a rear side of the insulative main housing wherein the contact housing is received within the front mating portion and the cable is received within the sleeve. The receptacle connector comprises a metallic housing defining a tubular mating section with a stadium like cross-section thereof; an insulative housing received within the metallic housing; a pair of receptacle contacts insert-molded within the insulative housing; and an insulative cover enclosing the metallic housing. The tubular mating section of the metallic housing of the receptacle connector is received within a circumferential gap form between the insulative main housing and the EMI shell of the cable connector.

Other objects, advantages and novel features of the disclosure will become more apparent from the following detailed description when taken in conjunction with the accompanying drawings.

DETAILED DESCRIPTION OF THE PREFERRED EMBODIMENT

Figure 1A:
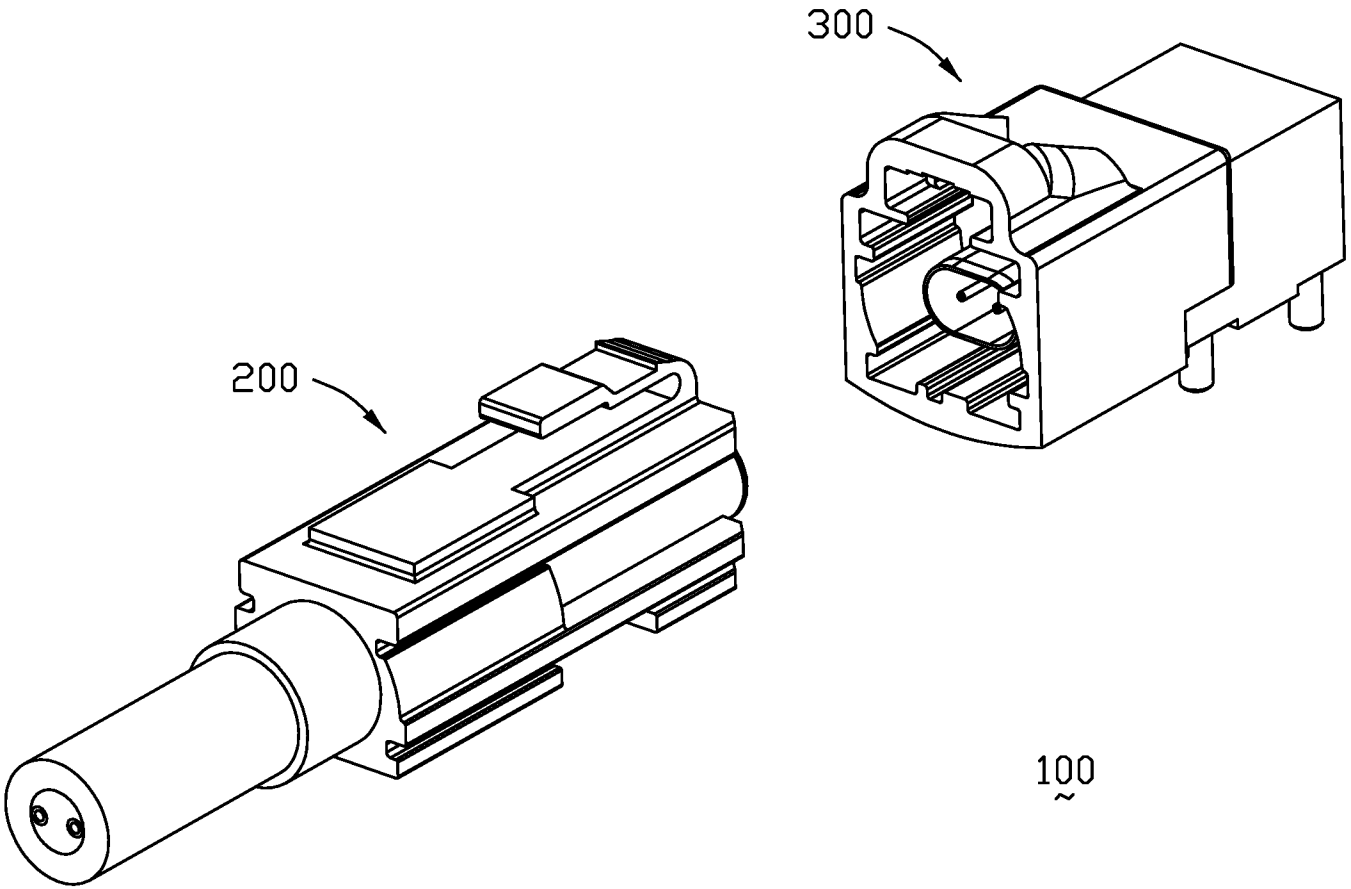
FIG. 1(A) is a perspective view of an electrical connector assembly including a cable connector and a receptacle connector adapted to be mated with each other according to a preferred embodiment of the invention.
Figure 1B:
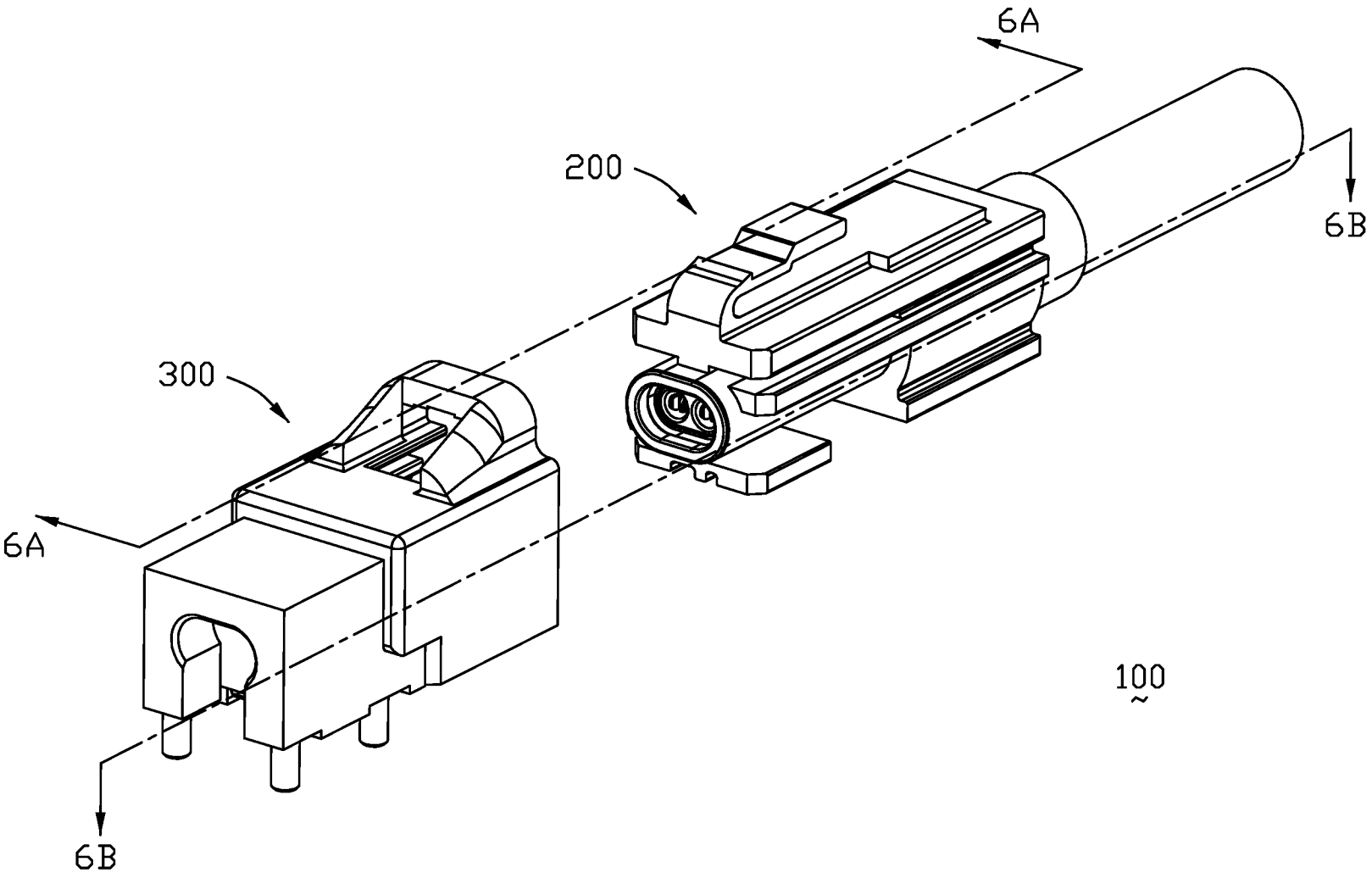
FIG. 1(B) is another perspective view of the electrical connector assembly of FIG. 1(A)
Figure 1C:
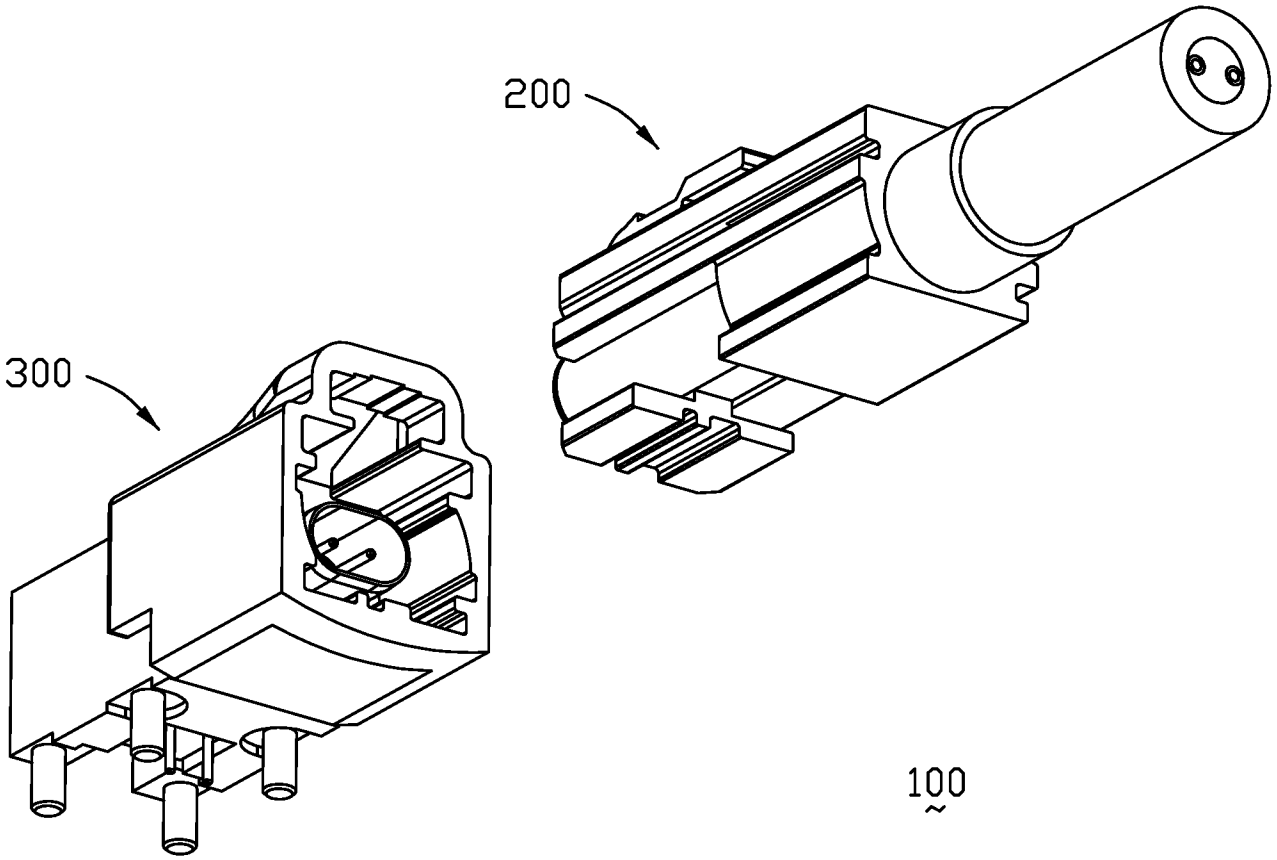
FIG. 1(C) is another perspective view of the electrical connector assembly of FIG. 1(A)
Figure 2:
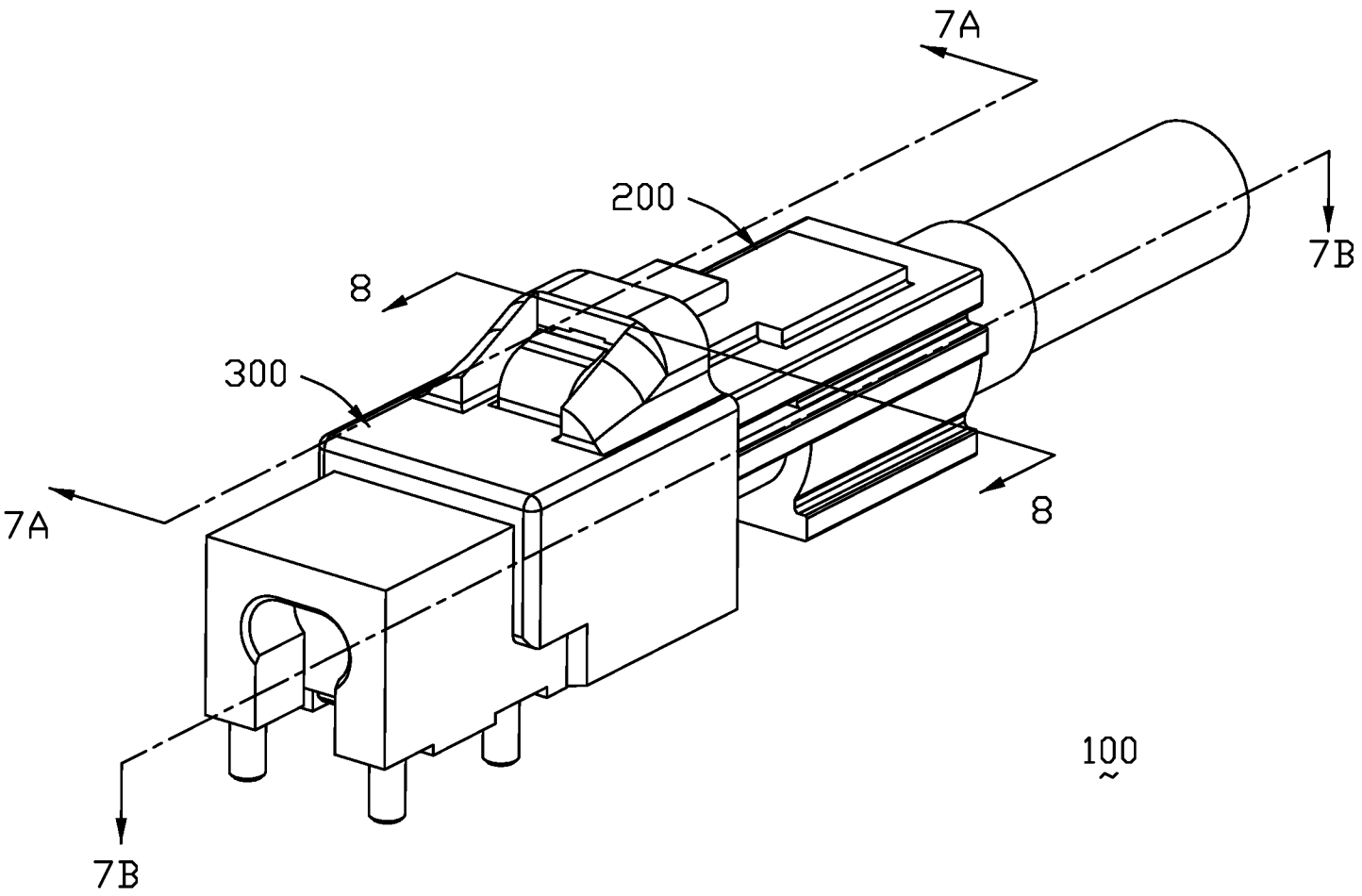
FIG. 2 is a perspective view of the electrical connector assembly of FIG. 1(B) in a mated manner.
Figure 3A:
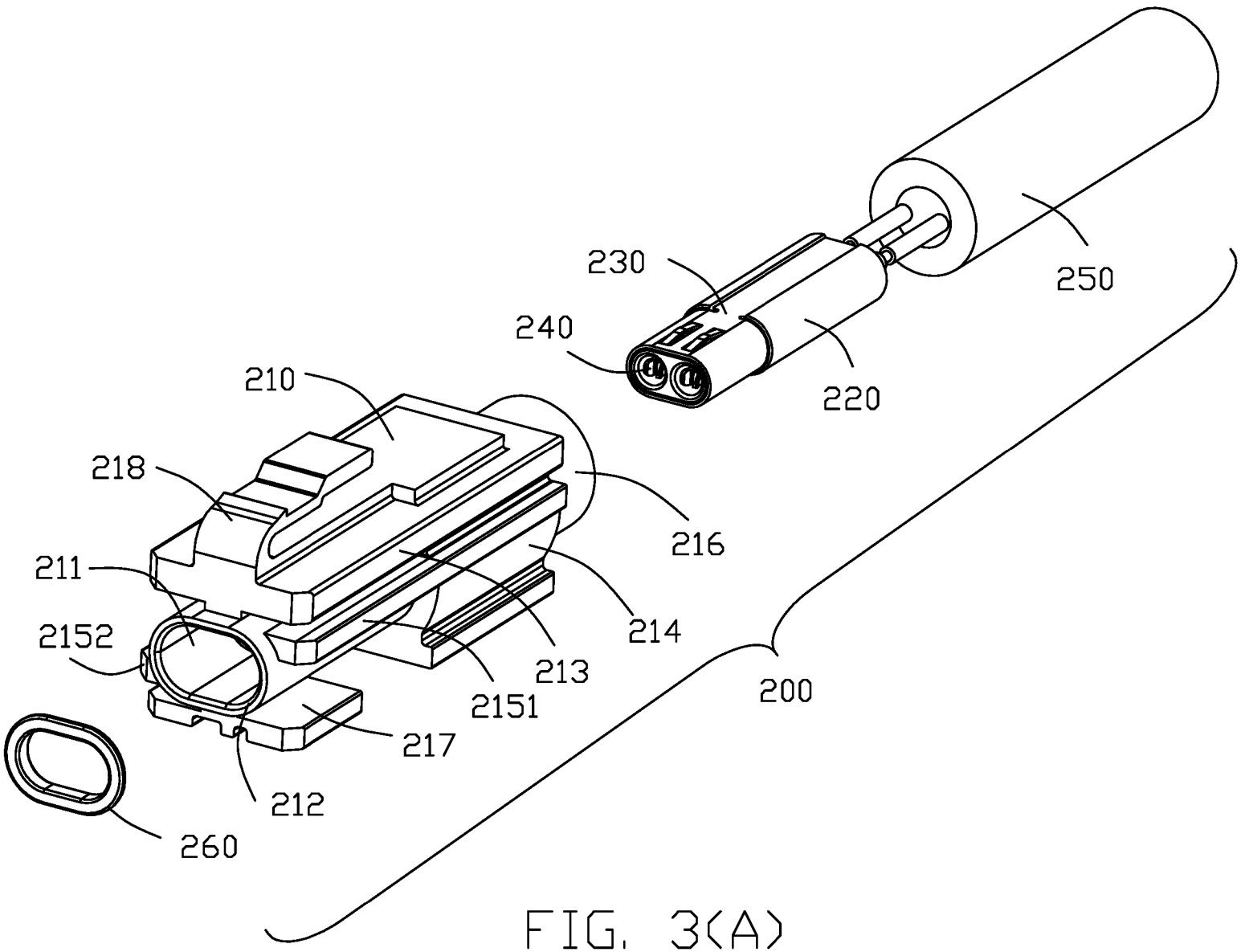
FIG. 3(A) is an exploded perspective view of the cable connector in FIG. 1(B)
Figure 3B:
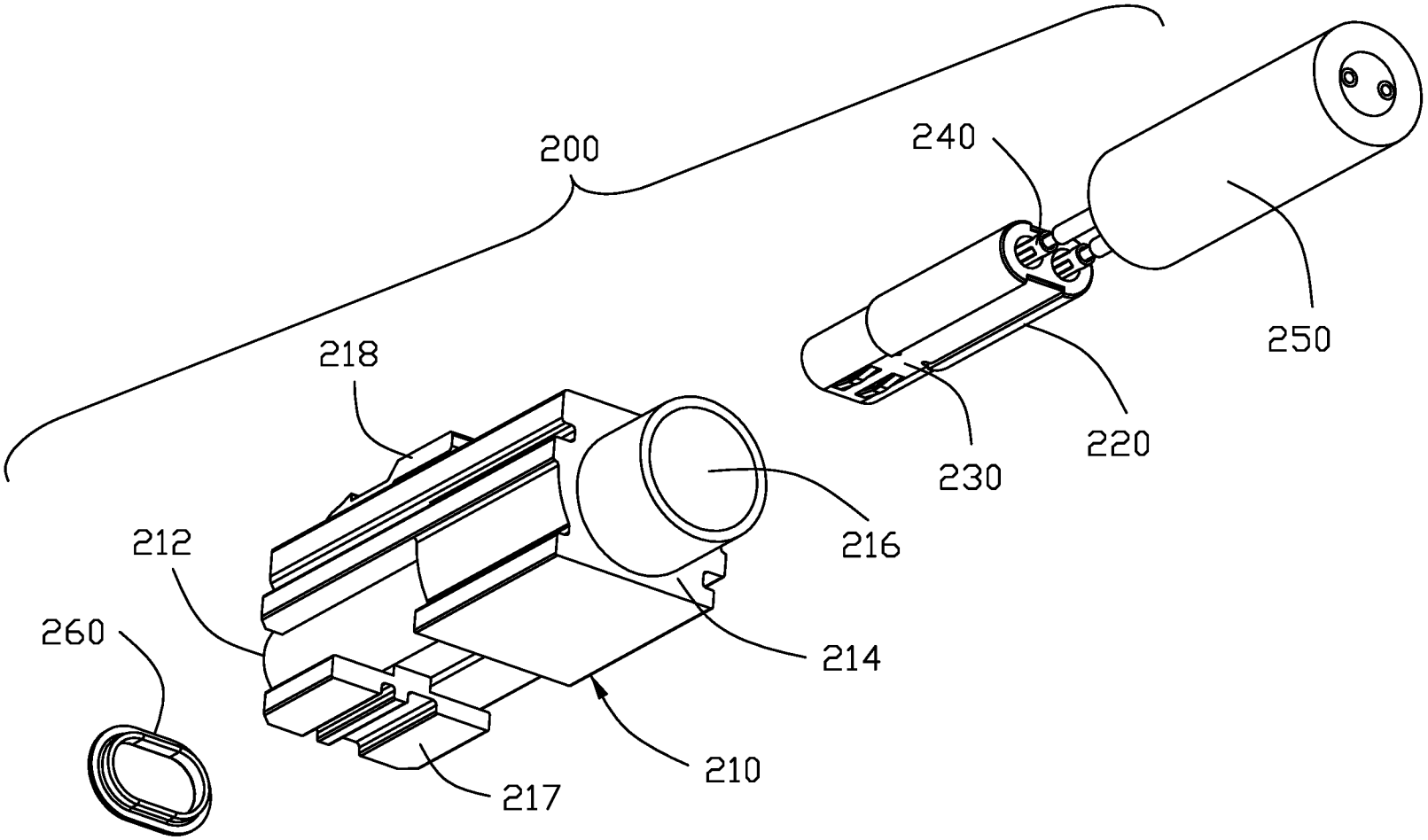
FIG. 3(B) is another exploded perspective view of the cable connector of FIG. 3(A)
Figure 4A:
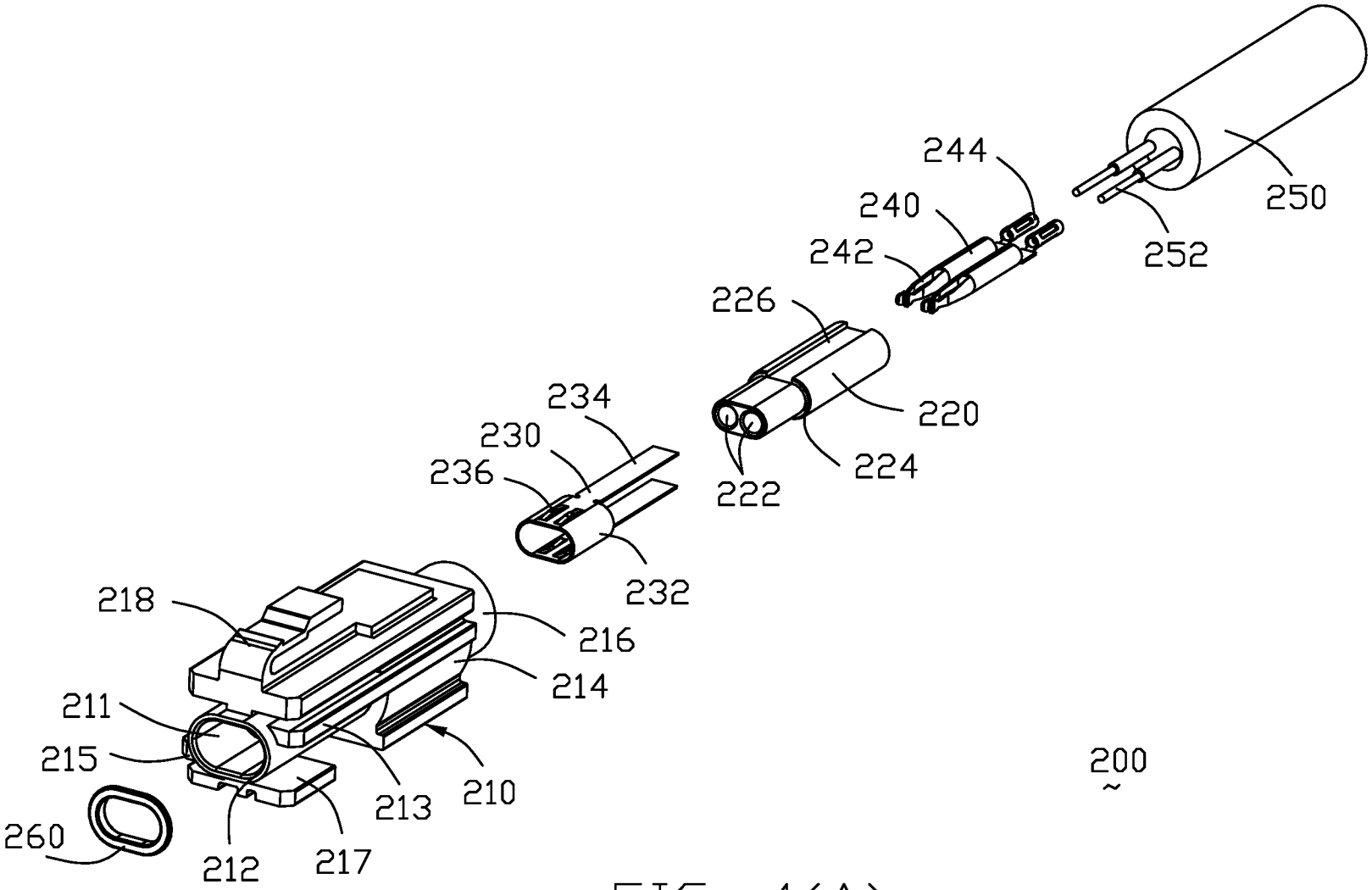
FIG. 4(A) is a further exploded perspective view of the cable connector of FIG. 3(A)
Figure 4B:
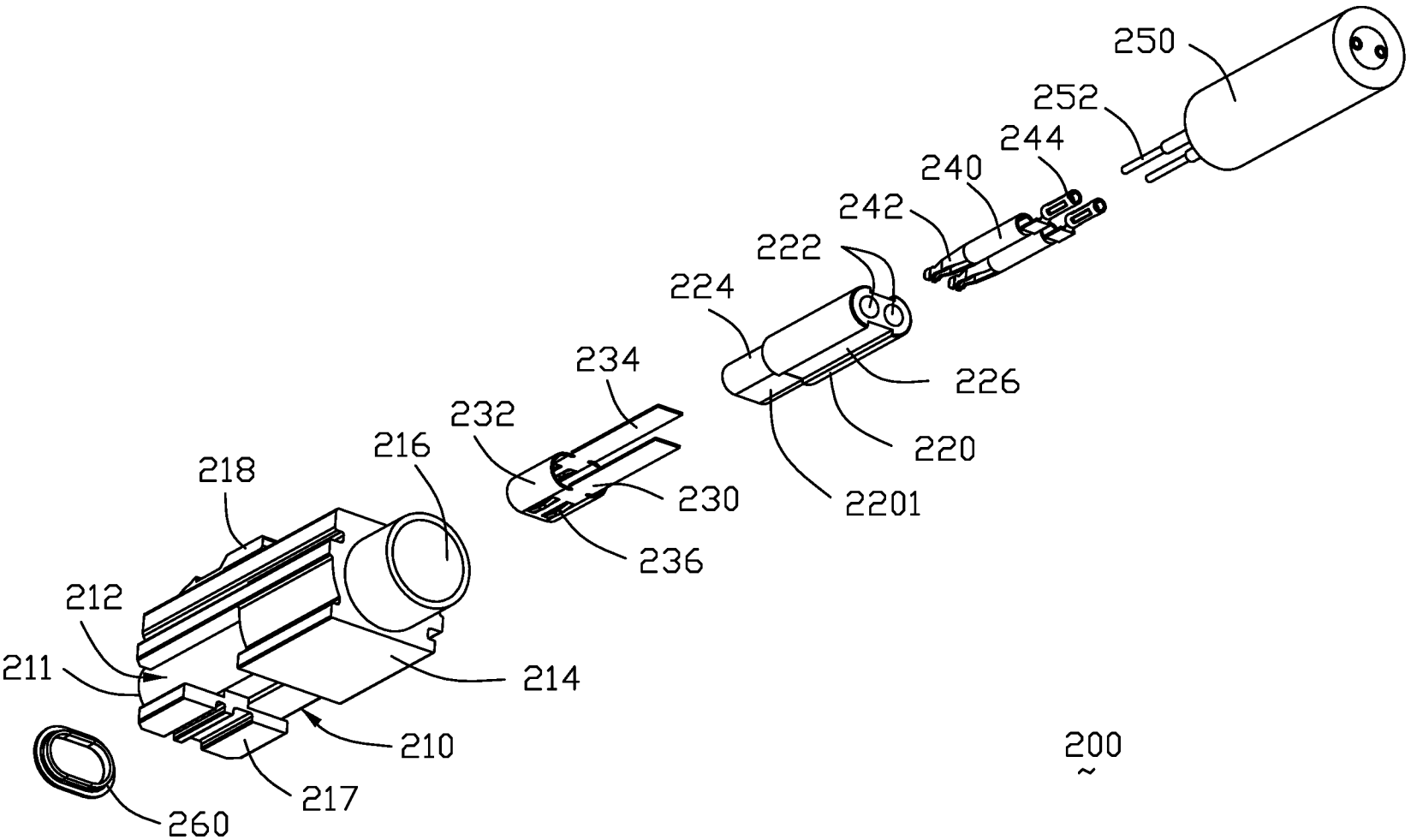
FIG. 4(B) is another exploded perspective view of the cable connector of FIG. 4(A)
Figure 5A:
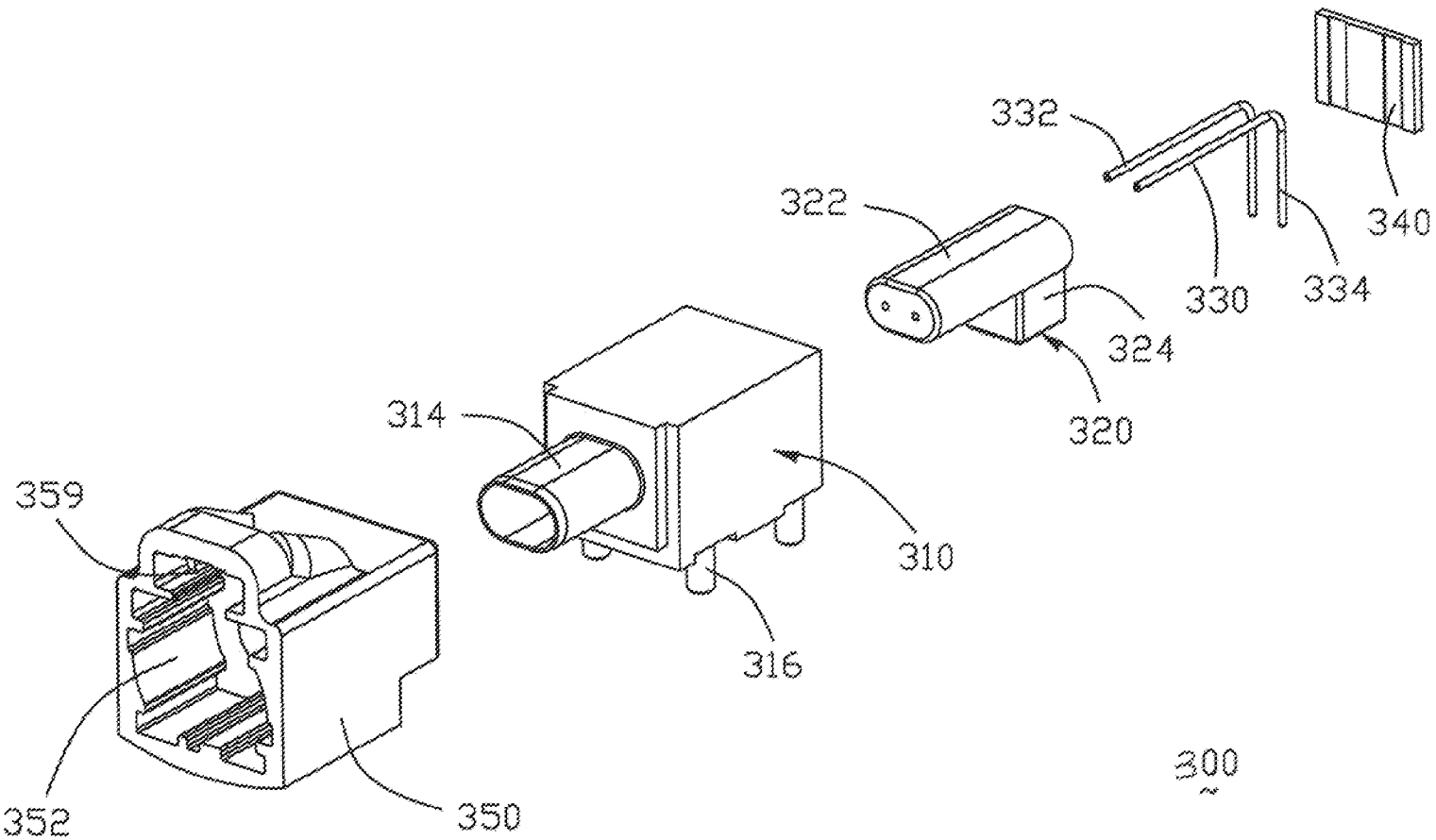
FIG. 5(A) is an exploded perspective view of the receptacle connector in FIG. 1(A)
Figure 5B:
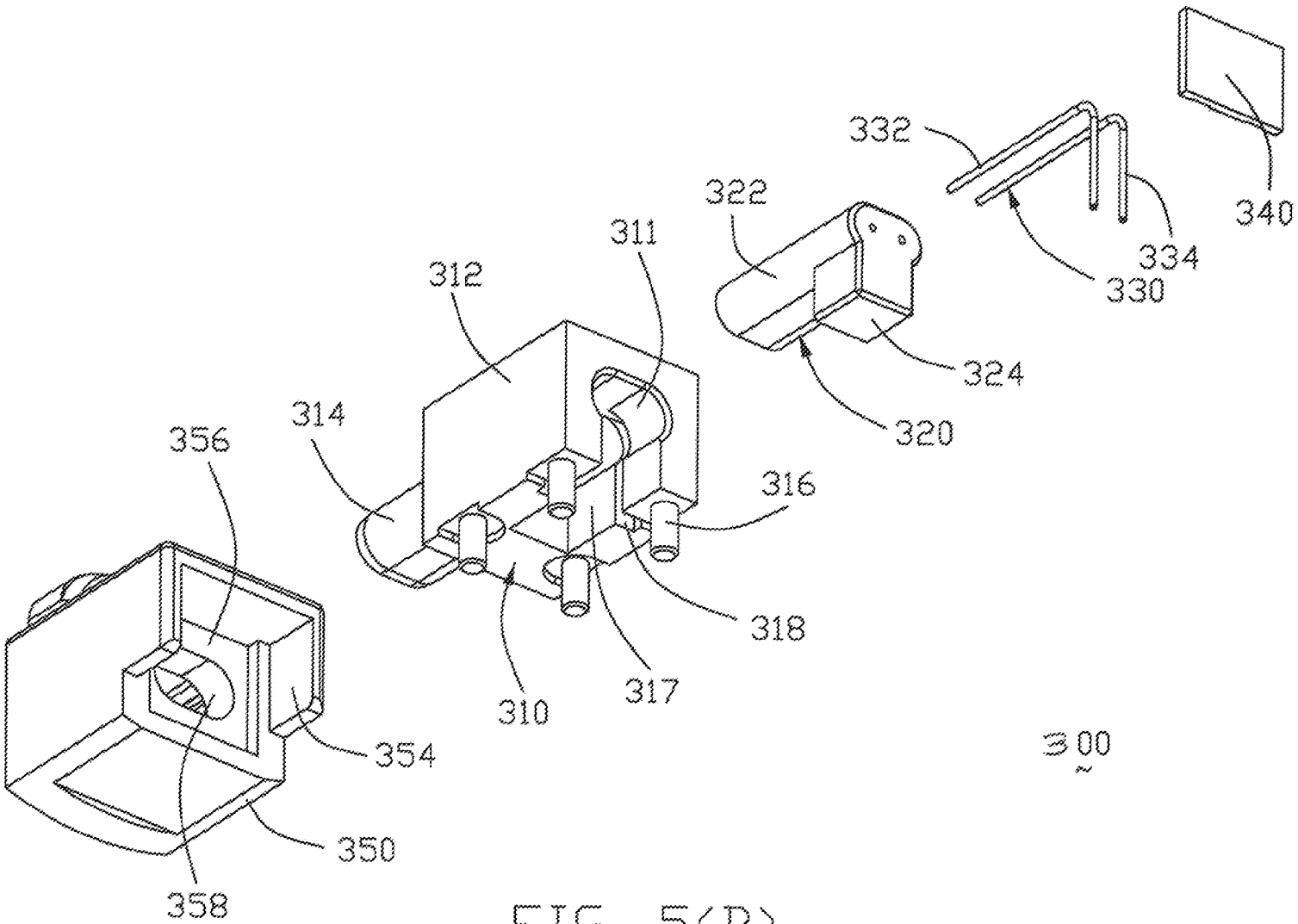
FIG. 5(B) is another exploded perspective view of the receptacle connector of the electrical connector assembly of FIG. 5(A)

Referring to FIGS. 1-8, an electrical connector assembly 100 includes a cable connector 200 and a receptacle or board connector 300 adapted to be mated with each other. The cable connector 200 is connected with a cable and the receptacle connector 300 is adapted to be mounted on a printed circuit board as shown in FIGS. 9(A)-19.

The cable connector 200 includes an insulative main housing 210, an insulative contact housing 220, a metallic EMI (Electro-Magnetic Interference) shell 230, a pair of contacts 240, a cable 250, and an optional gasket 260.

The main housing 210 can be made from PET (Polyethylene terephthalate), and includes a front mating portion 212 and a rear holding portion 214, a round sleeve 216 at a rear end of the holding portion 214, and a deflectable latch 218 above the mating portion 212. Notably, the front mating portion 212 includes a capsular tube 211 with an upper bar 213, a bottom bar 217, and an upper side bar 2151 and a lower side bar 2152 on the exterior surface thereof. The insulative contact housing 220 having a stadium like cross-section and a step structure 224 along the front-to-back direction, defines a pair of passageways 222 to receive the pair of contacts 240 therein, respectively, and a pair of channels 226 in the exterior surface thereof. Each contact 240 includes a front mating section 242 in shape of a pair of resilient arms and a rear connecting section 244. The front mating section 242 extend in two mating holes 2221 formed in the front portion of the passageways 222. The cable 250 includes a pair of wires 252 respectively crimped by the connecting sections 244 of the corresponding contacts 240. The EMI shell 230 has a front tubular section 232 enclosing the front portion 2201 of the contact housing 220, and a pair of plates 234 extending rearwardly from a rear edge of the tubular section 232 to be received within the corresponding channels 226, respectively. A plurality of spring tangs 236 extend on the front tubular section 232. The contact housing 220 with the associated shell 230 thereon and the contacts 240 therein, is inserted into the capsular tube 211. The gasket 260 is attached upon a front end face of the capsular tube 211. The step structure 224 located between the front portion 2201 and the rear portion of the contact housing 220 may forwardly abut against a corresponding step structure (not shown) in the interior surface of the front main portion 212.

Figure 6A:
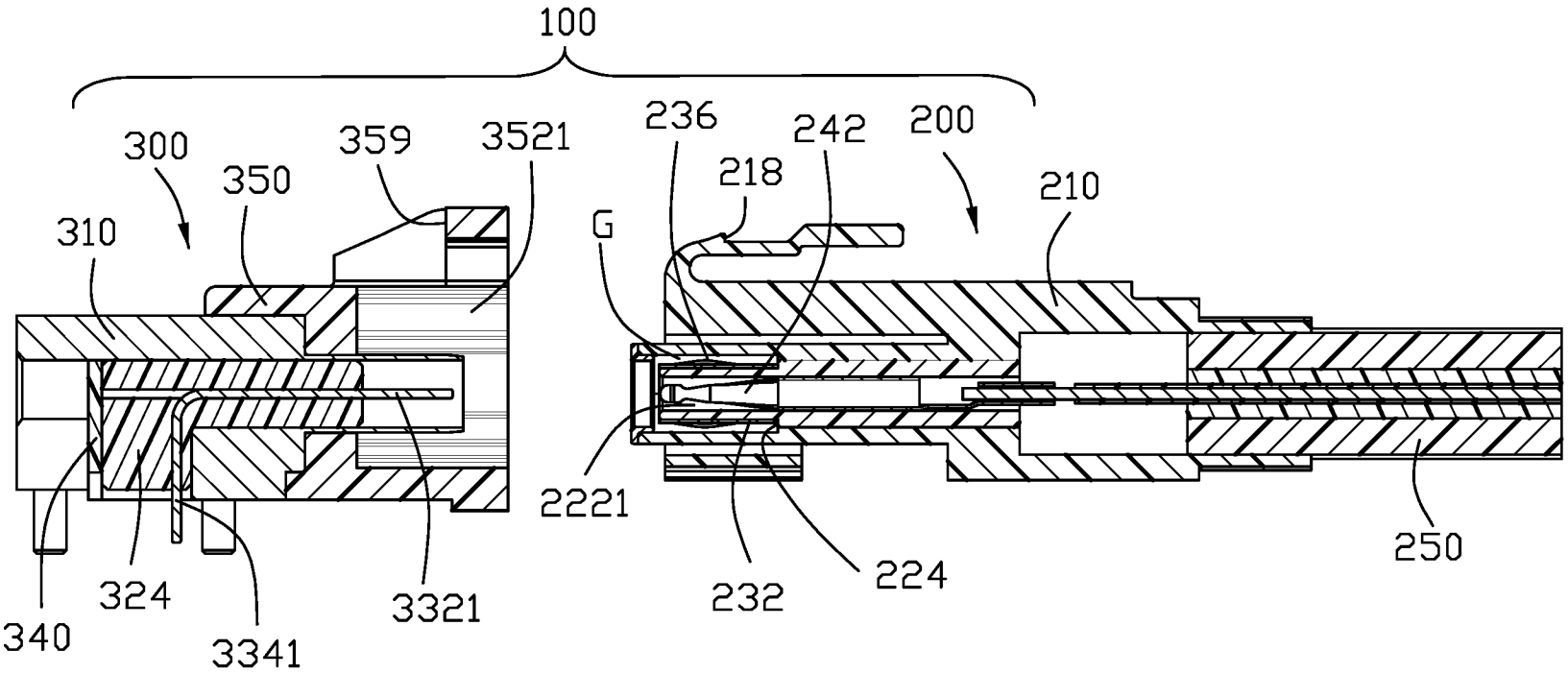
FIG. 6(A) is a cross-sectional view of the electrical connector assembly taken along lines 6A-6A in FIG. 1(B)
Figure 6B:
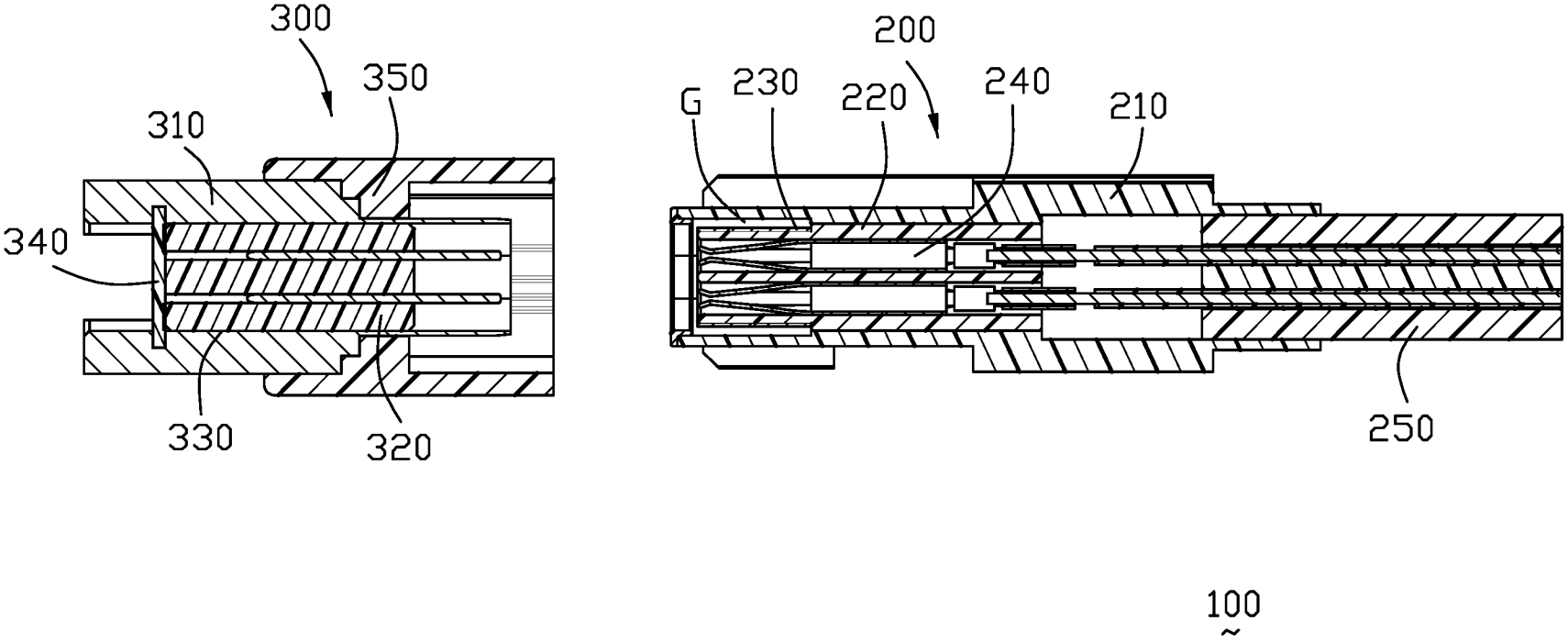
FIG. 6(B) is a cross-sectional view of the electrical connector assembly taken along lines 6B-6B in FIG. 1(B)
Figure 7A:
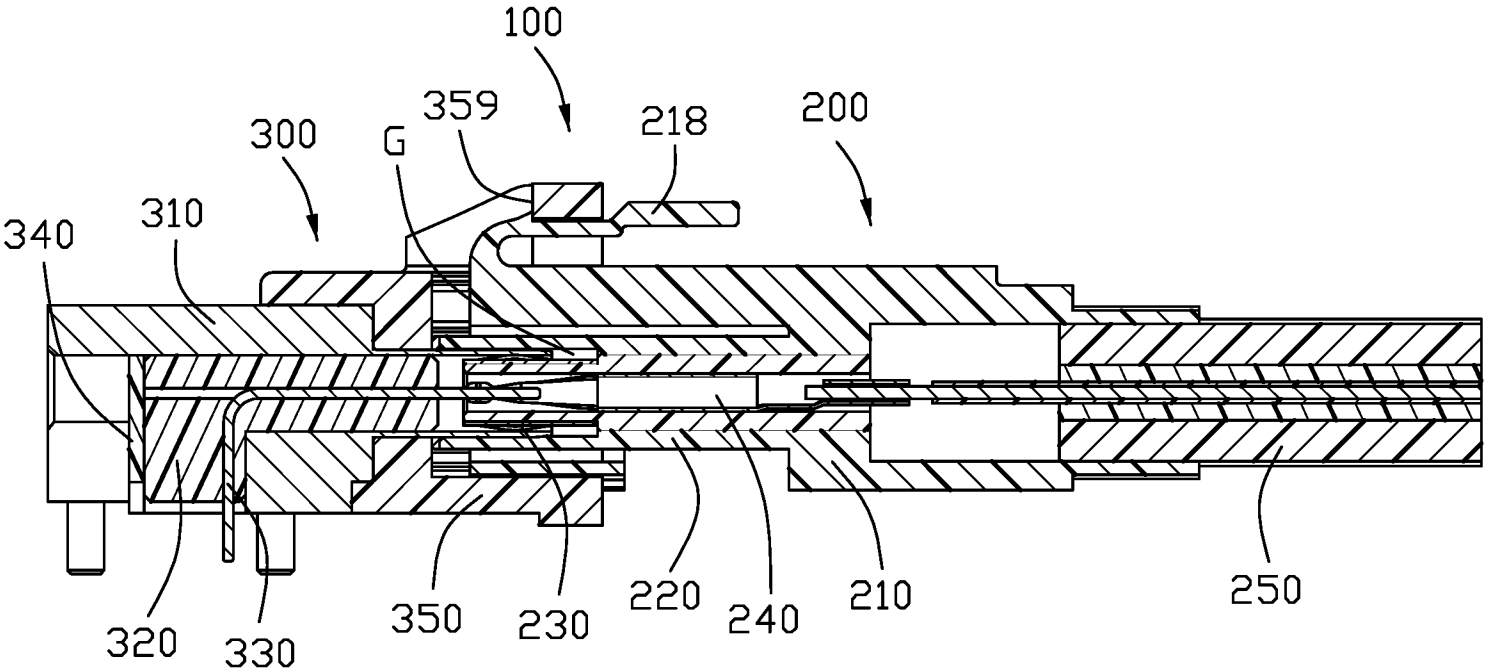
FIG. 7(A) is a cross-sectional view of the electrical connector assembly taken along lines 7A-7A in FIG. 2.
Figure 7B:
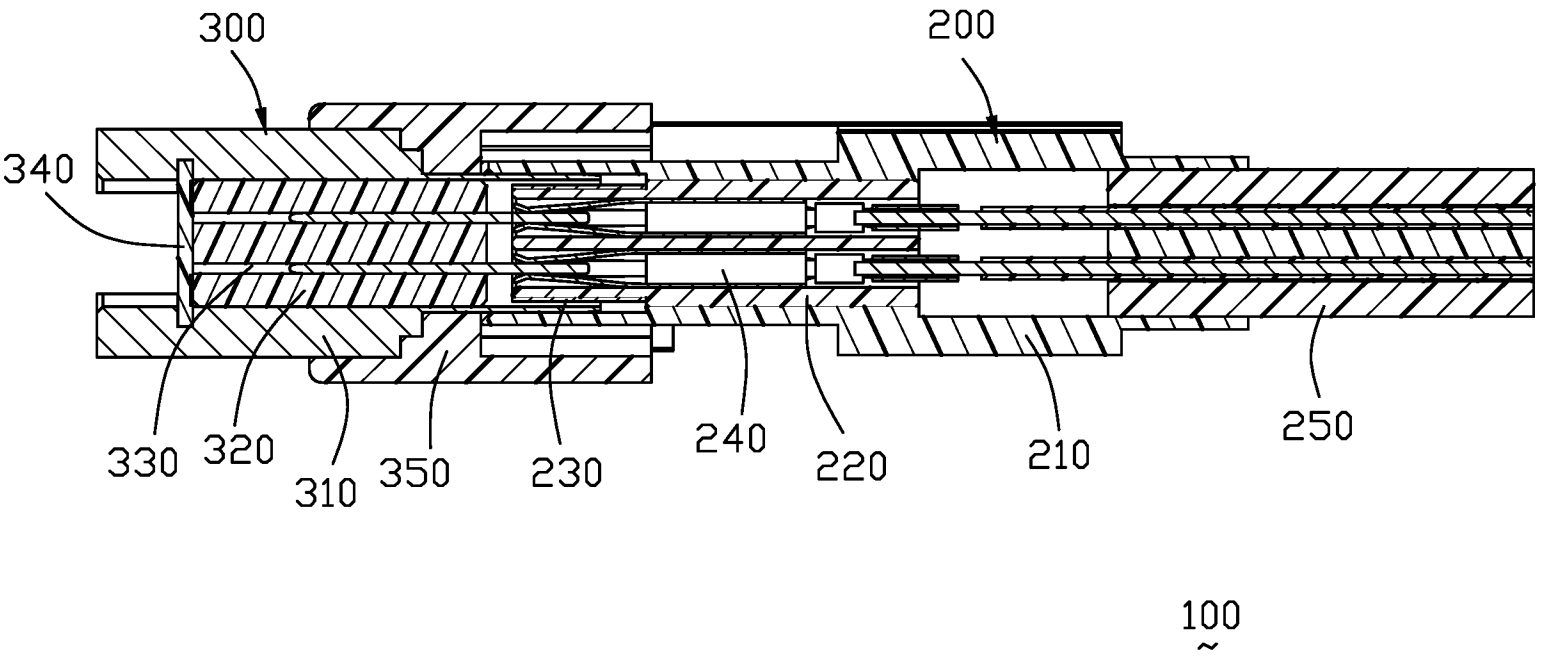
FIG. 7(B) is a cross-sectional view of the electrical connector assembly taken along lines 7B-7B in FIG. 2.

The receptacle connector 300 includes a metallic housing 310, an insulative housing 320, a pair of contacts 330. The insulative housing 320 includes a main portion 322 with a stadium like cross-section along the front-to-back direction, namely a two-dimensional geometric shape constructed of a rectangle with semicircles at a pair of opposite sides, and a stand 324 positioned below the main portion 322. The contacts 330 are insert-molded within the insulative housing 320 and each contact 330 includes a horizontal section 332 and a vertical section 334. As best shown in FIG. 6(A), the front portions of the horizontal section 332 extending beyond the front face of the main portion 322 of the housing 320 are functioned as front mating sections 3321. The lower portions of the vertical sections 334 extending below the stand 324 are functioned as solder sections 3341 for mounting to the printed circuit board on which the receptacle connector 300 is seated.

The metallic housing 310 includes a square main body 312 and a tubular mating section 314 extending forwardly therefrom with a stadium like cross-section thereof. The main body 312 forms a passageway 311 extending through a rear side and in compliant alignment with the tubular mating section 314 along the front-to-back direction, and a cavity 317 communicatively below the passageway 311 in the vertical direction. Four posts 316 are formed on a bottom side of the main body 312 for mounting to a printed circuit board (not shown) on which the receptacle connector 300 is seated. A groove 318 extends from a bottom side of the main body 312 and is terminated without through the upper side of the main body 312 in the vertical direction. The mating sections 3321 extend in the tubular mating section 314.

The insulative outer cover 350 forms a front receiving cavity 352, a rear retaining space 354 and a dividing wall 356 therebetween with a passage 358 extending therethrough in the front-to-back direction wherein the passage 358 is dimensioned to snugly receive the tubular mating section 314. A locking shoulder 359 is formed on a top side of the outer cover 350 around the front opening of the receiving cavity 352. A ring cavity 3521 is defined between the inside of the cover 350 and the tubular mating section 314. When assembled, the insulative housing 320 with the associated contacts 330 is forwardly inserted into the metallic housing 310 from a rear side of the metallic housing 310 so as to have the main portion 322 of the insulative housing 320 received within the tubular mating section 314 and the stand 324 received within the cavity 317. The retainer 340 is upwardly inserted into the groove 318 to prohibit backward movement of the insulative housing 320 relative to the metallic housing 310. The mating section 314 forwardly extends through the passage 317 and enters the receiving cavity 352. The main body 312 is received within the retaining space 354.

Figure 8:
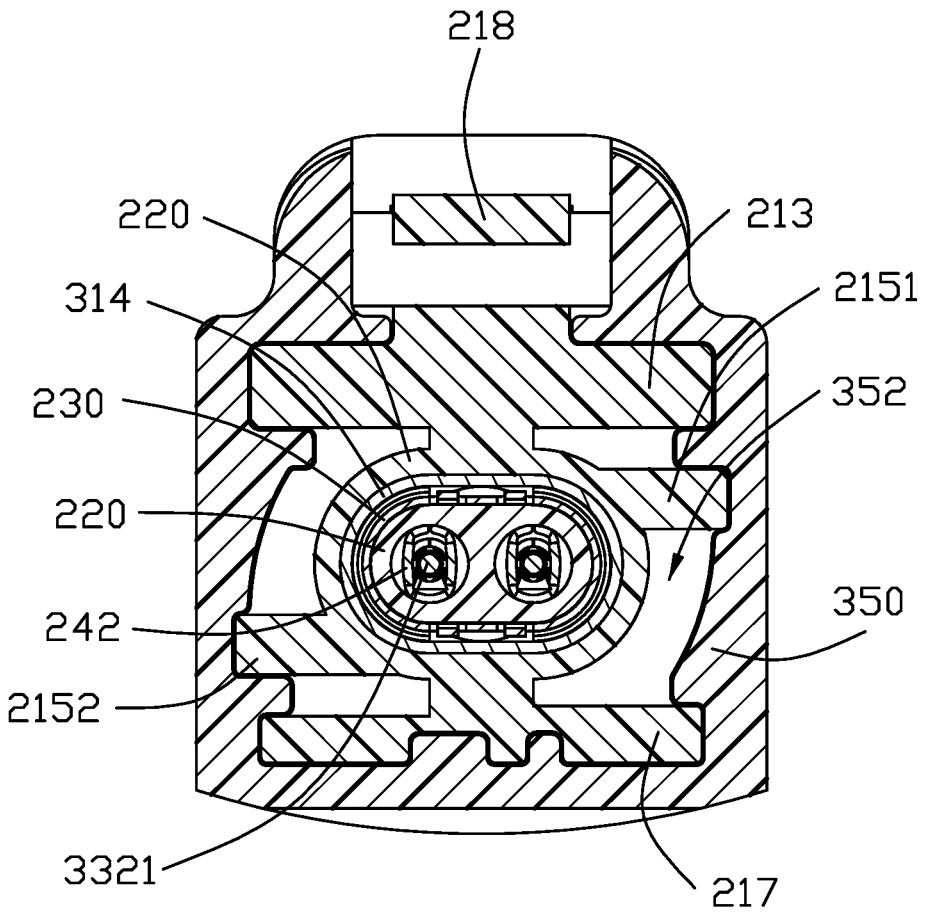
FIG. 8 is a cross-sectional view of the electrical connector assembly taken along lines 8-8 in FIG. 2.
Figure 9A:
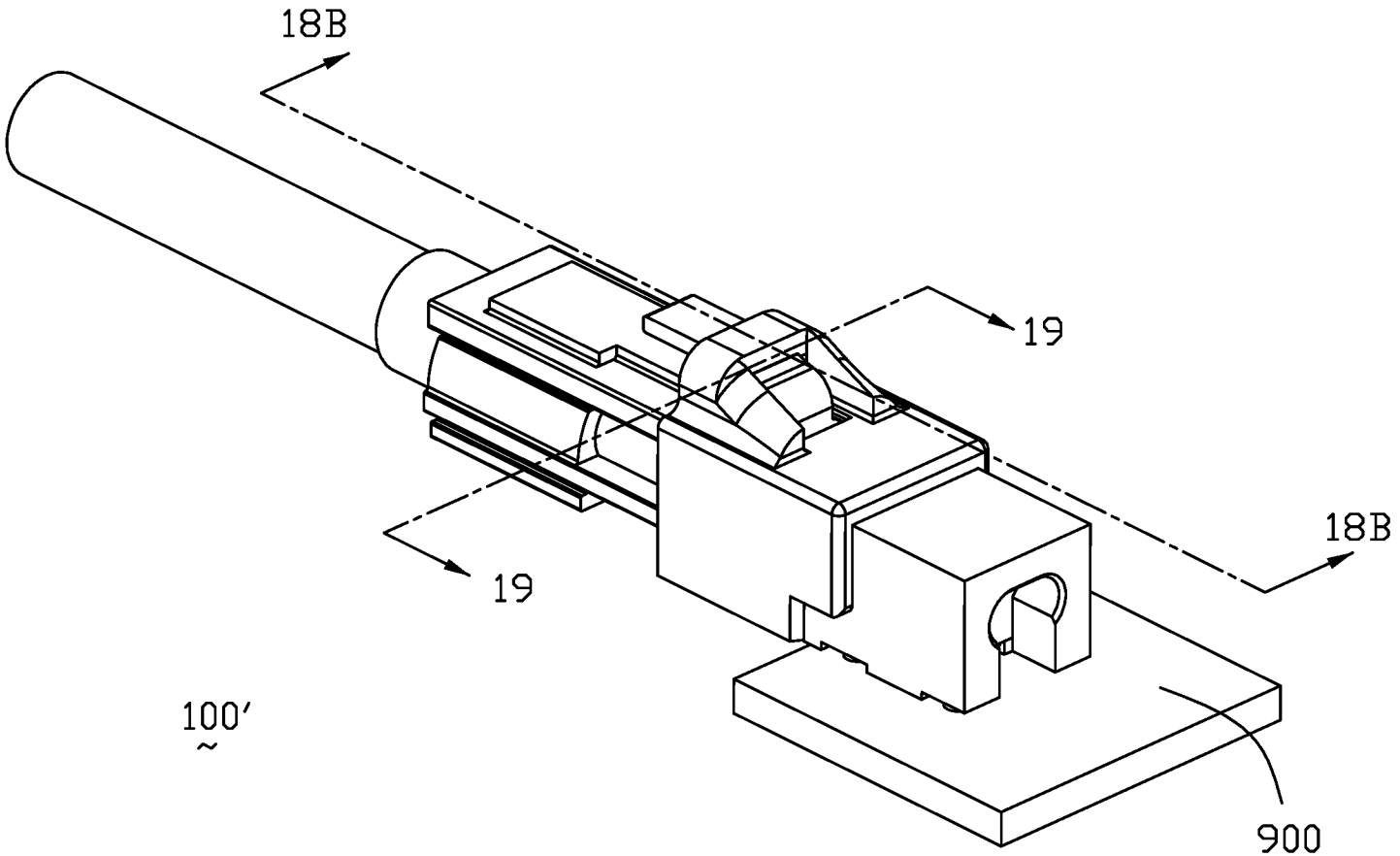
FIG. 9(A) is a perspective view of an electrical connector assembly including the mated cable connector and receptacle connector according to another embodiment of the invention.
Figure 9B:
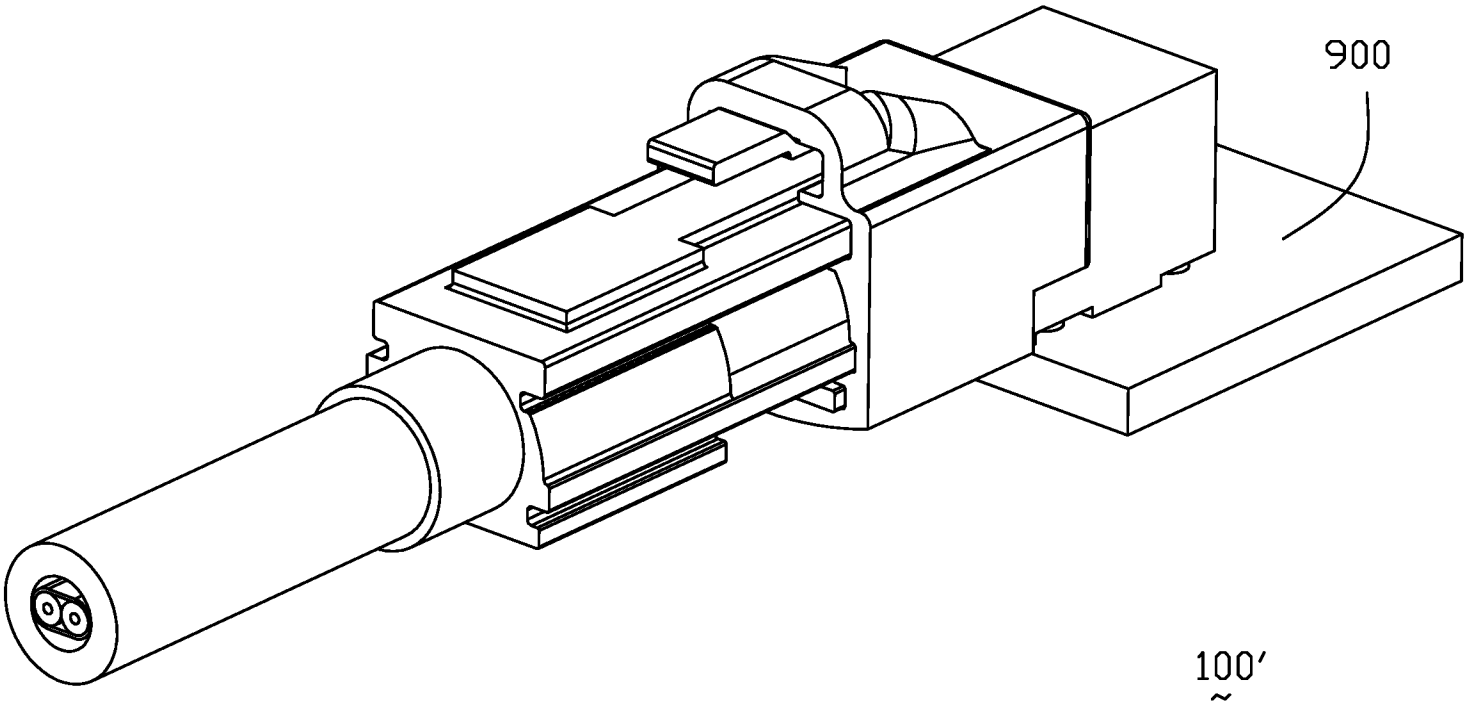
FIG. 9(B) is a perspective view of the electrical connector assembly of FIG. 9(A)
Figure 10A:
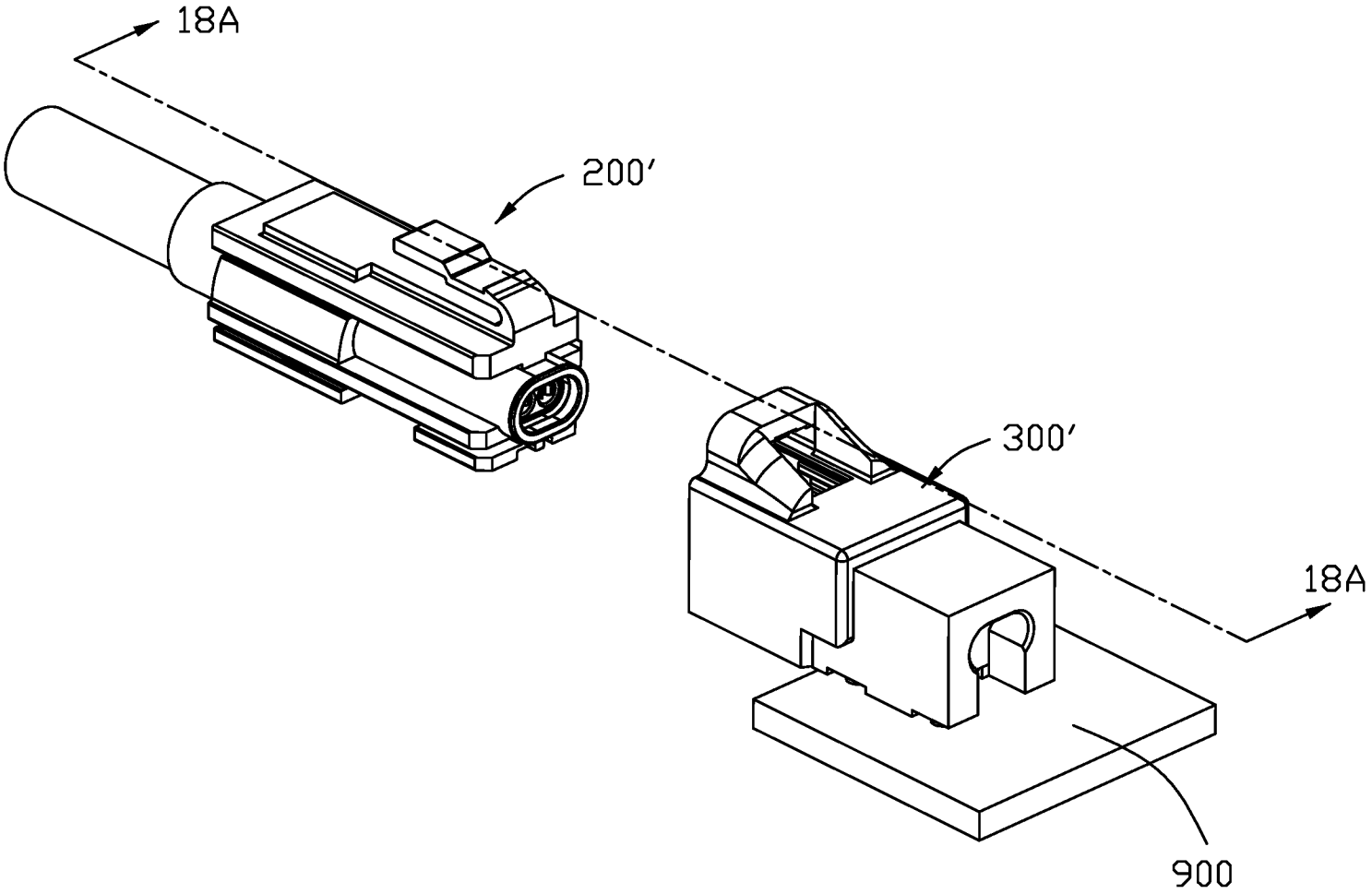
FIG. 10(A) is an exploded perspective view of the electrical connector assembly of FIG. 9(A) in an un-mated state.
Figure 10B:
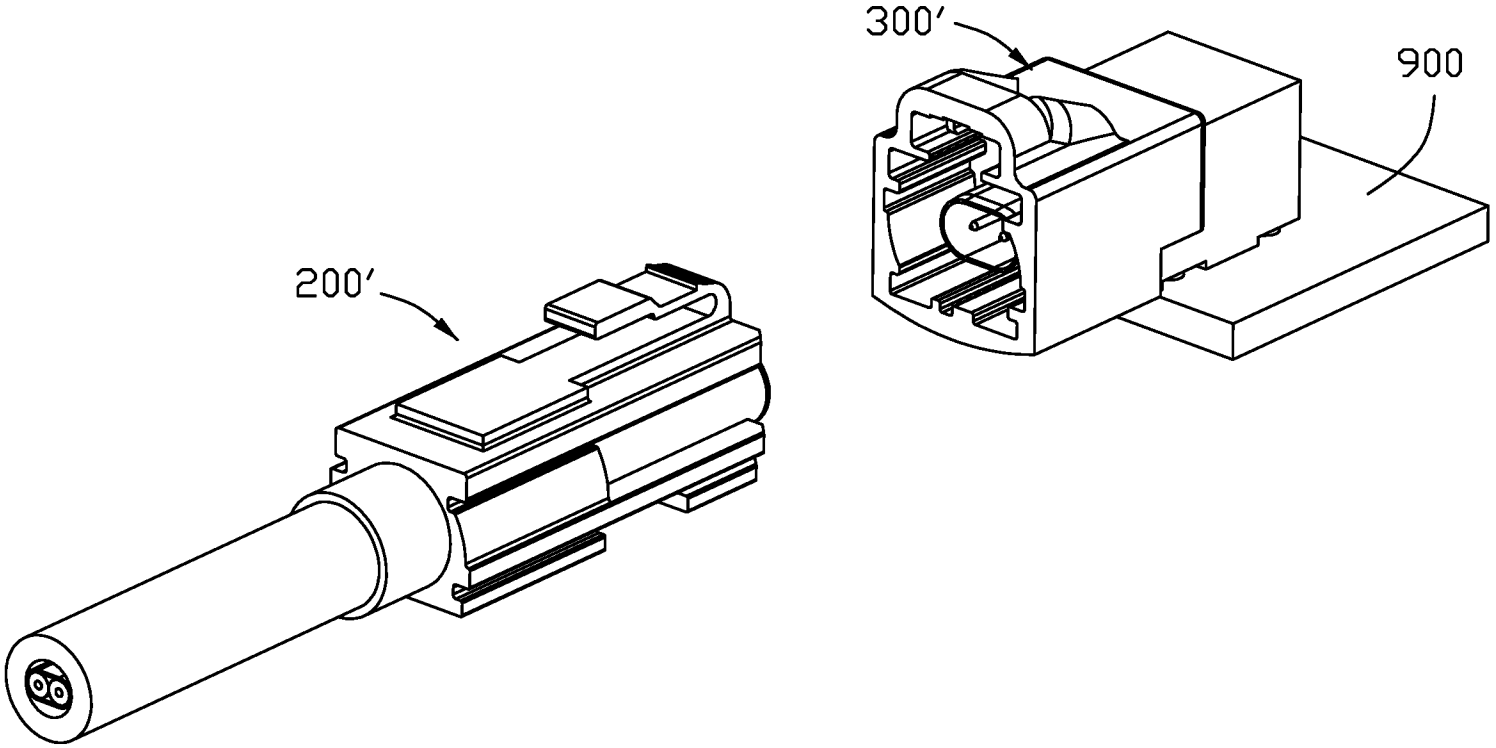
FIG. 10(B) is another exploded perspective view of the electrical connector assembly of FIG. 10(A)
Figure 11A:
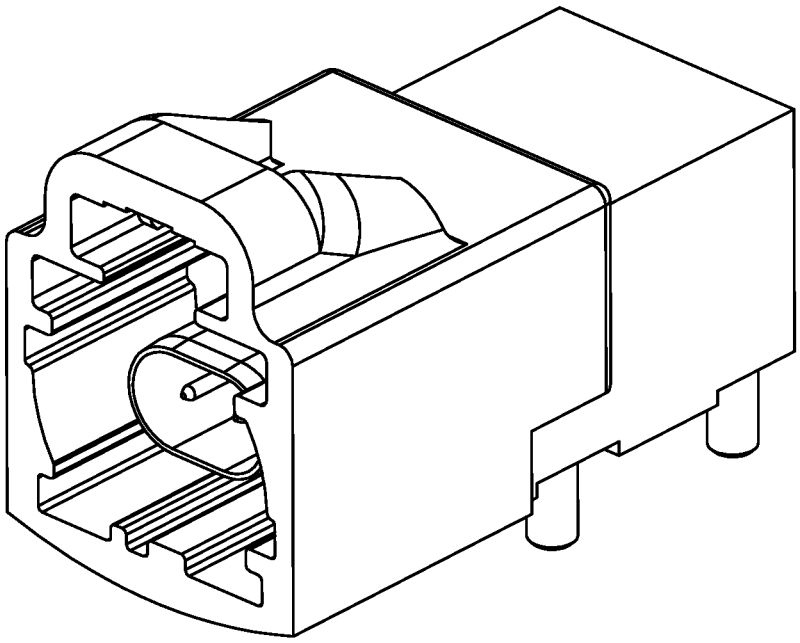
FIG. 11(A) is a perspective view of the receptacle connector in FIG. 10(B)
Figure 11B:
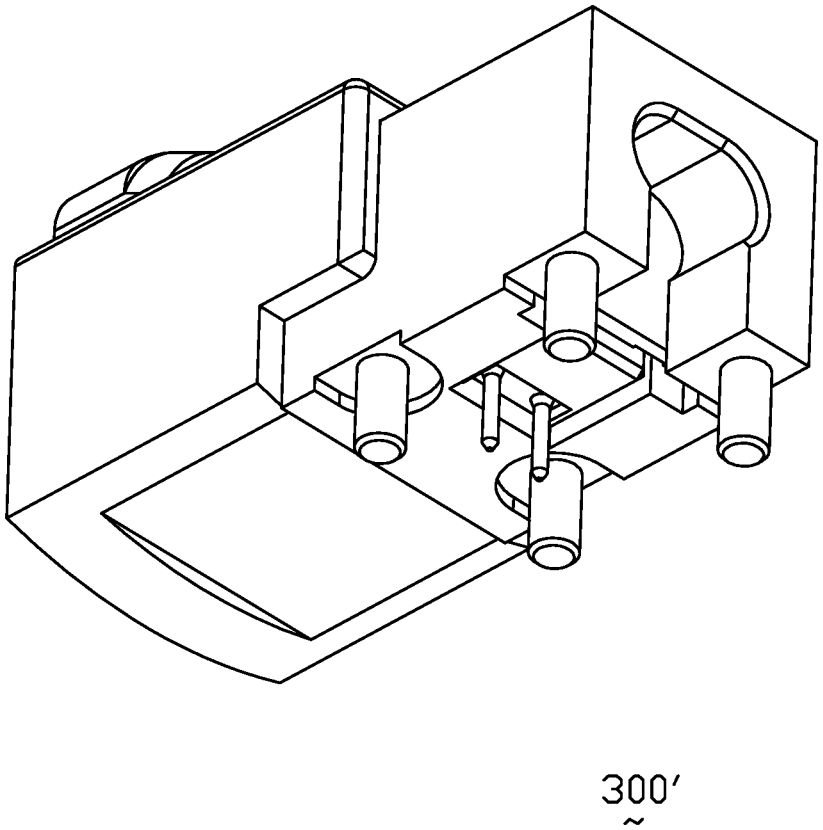
FIG. 11(B) is another perspective view of the receptacle connector of FIG. 11(A)
Figure 12A:
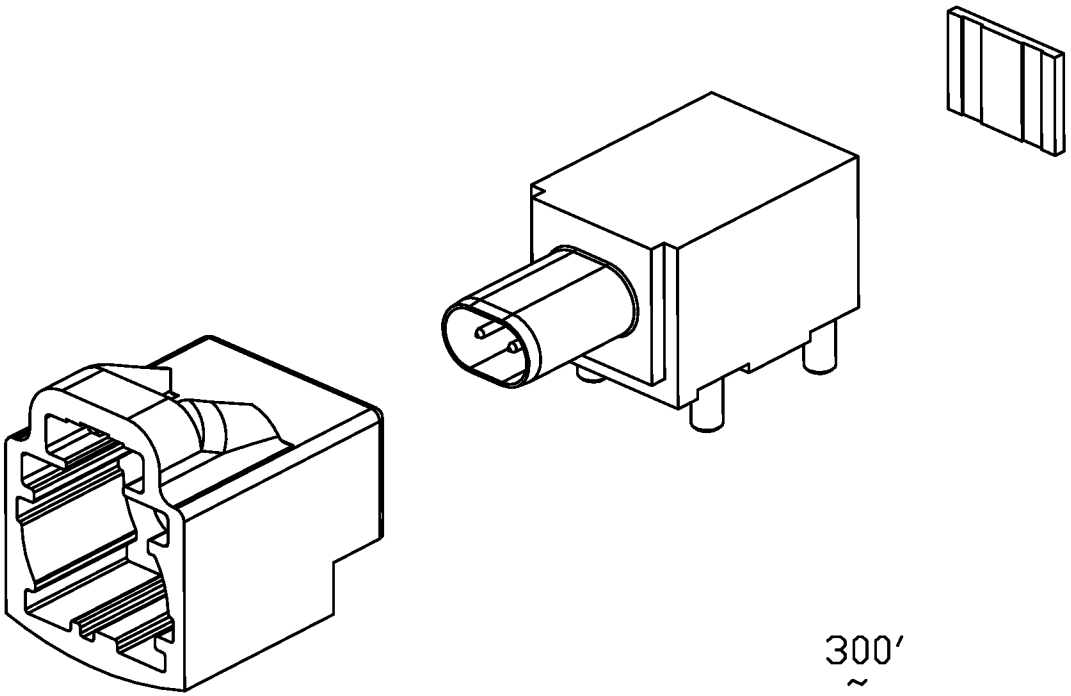
FIG. 12(A) is an exploded perspective view of the receptacle connector of FIG. 11(A)
Figure 12B:
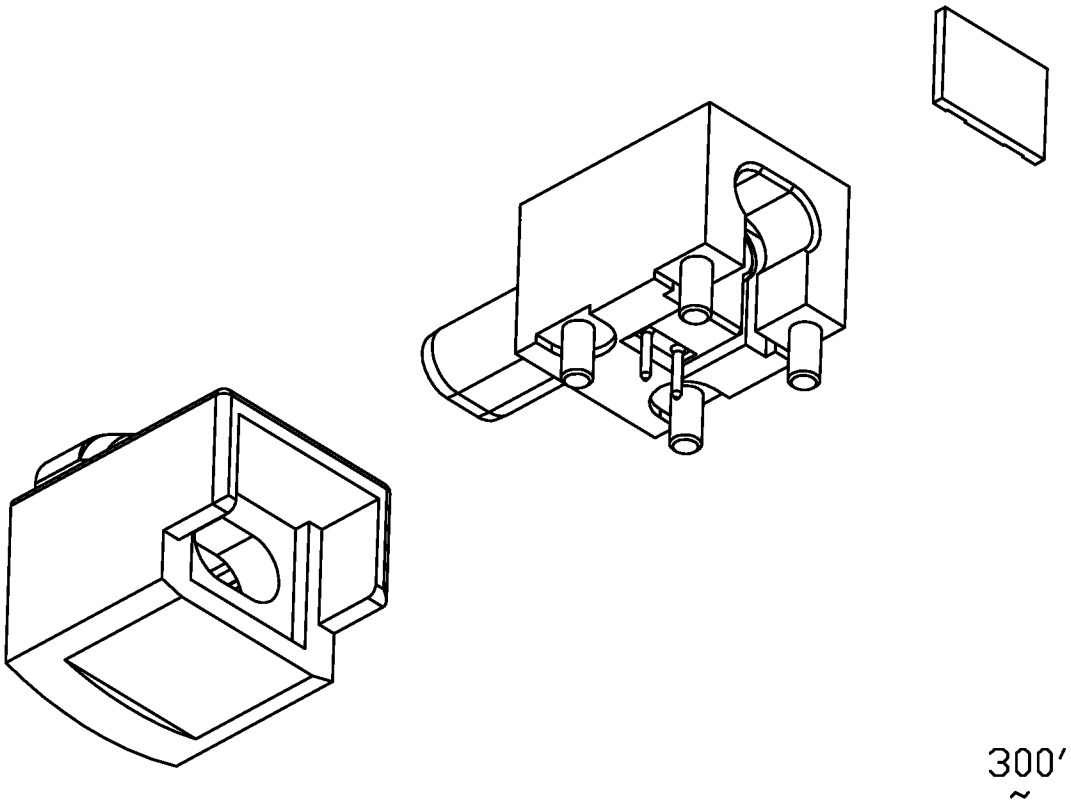
FIG. 12(B) is another exploded perspective view of the receptacle connector of FIG. 12(A)
Figure 13A:
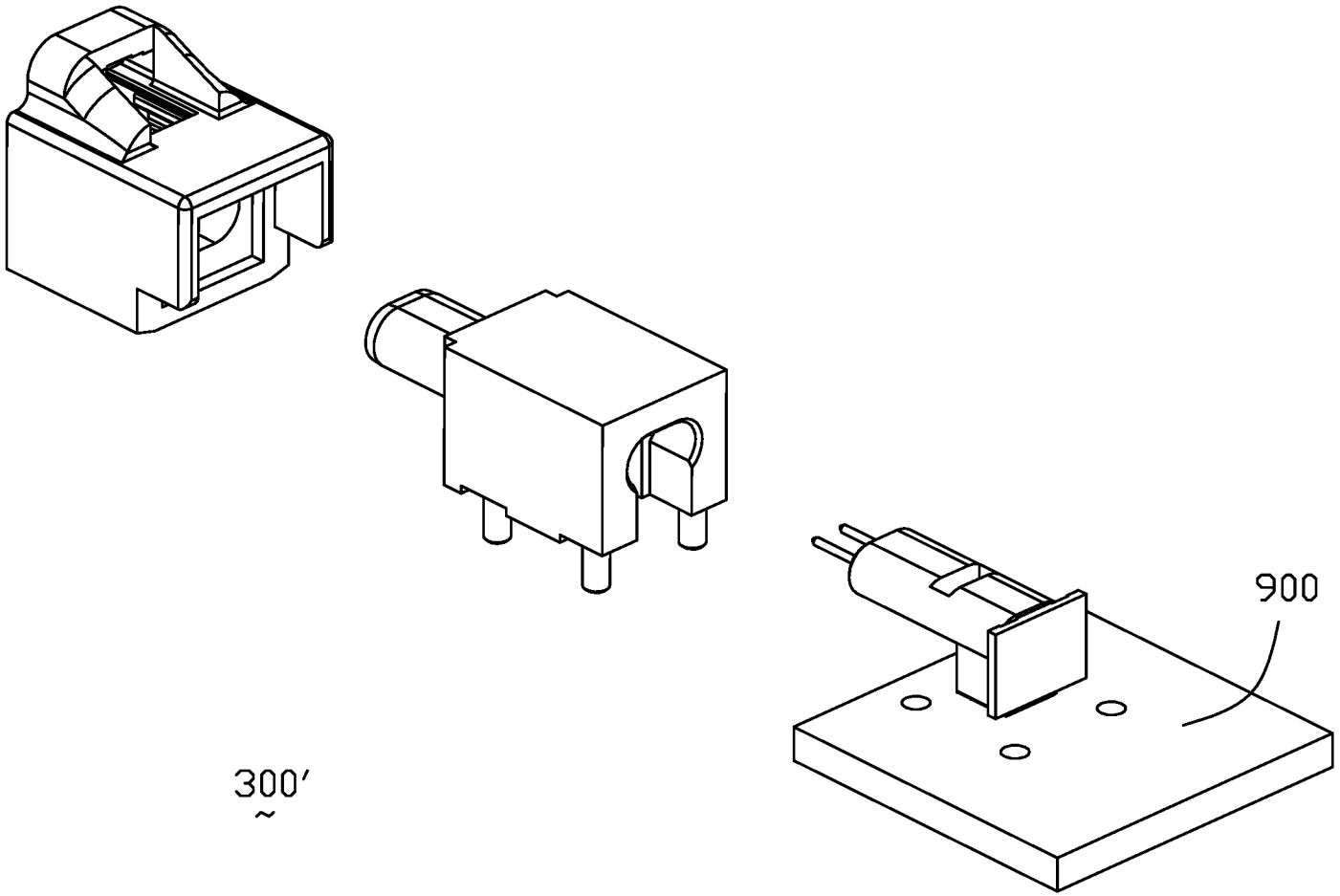
FIG. 13(A) is a further exploded perspective view of the receptacle connector of FIG. 11(B) mounted upon the printed circuit board.
Figure 13B:
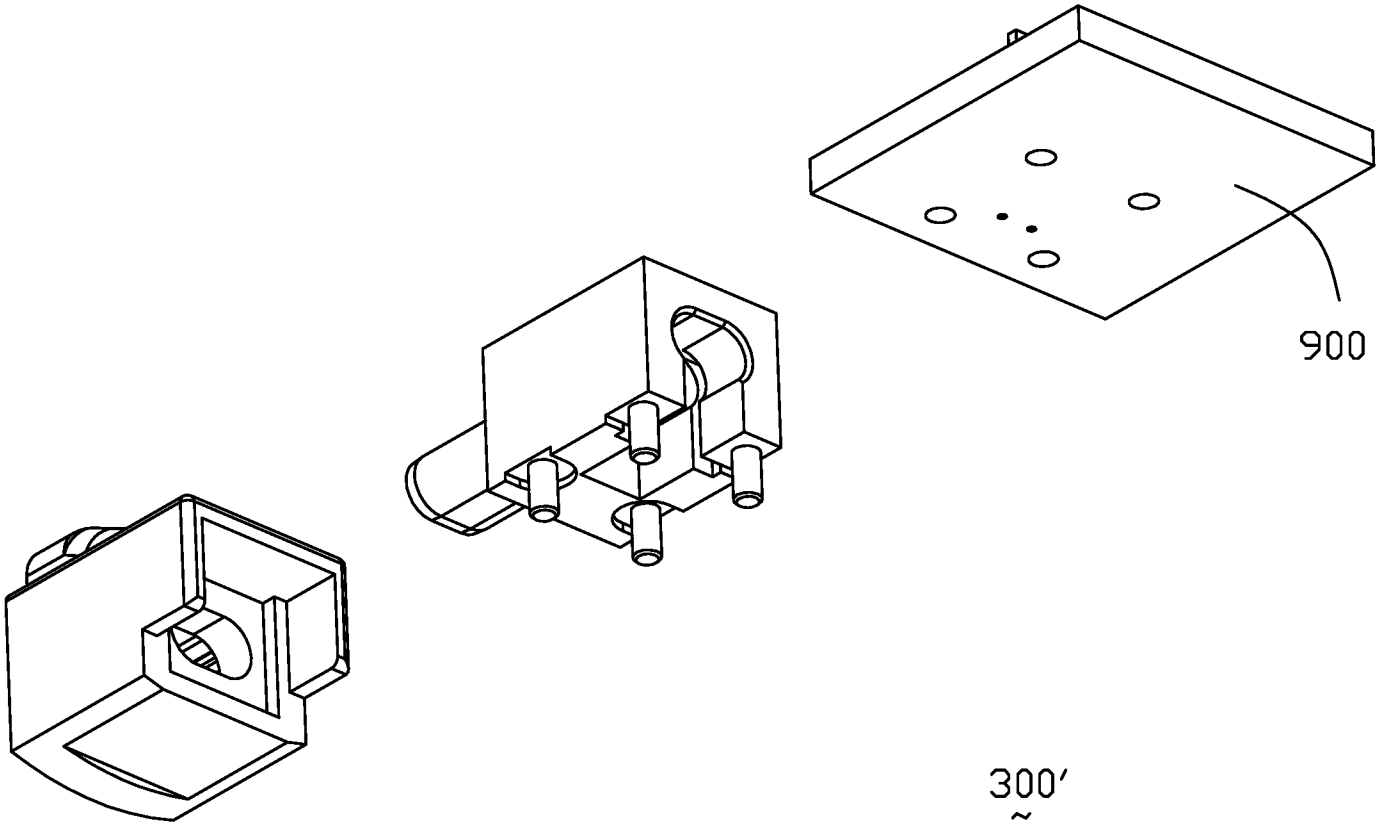
FIG. 13(B) is another exploded perspective view of the receptacle connector of FIG. 13(A)
Figure 14A:
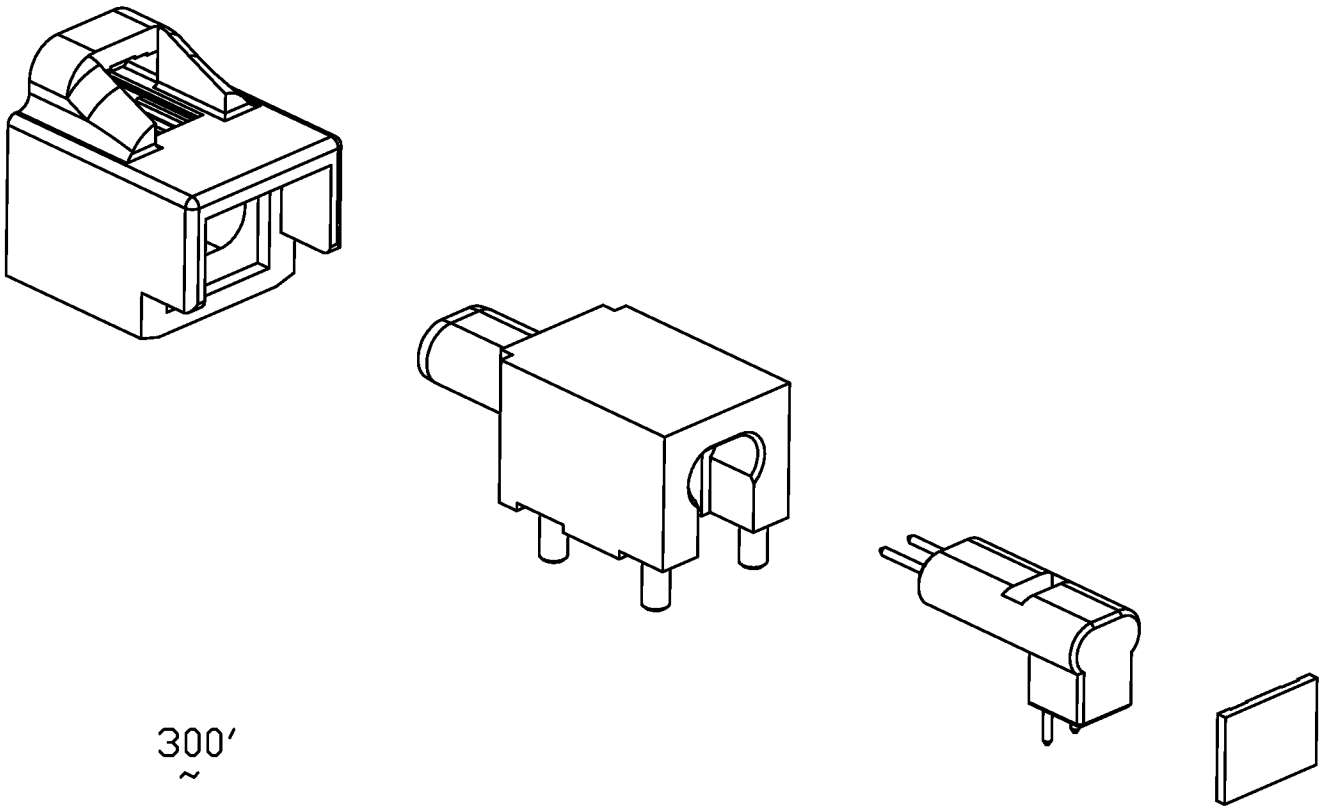
FIG. 14(A) is a further exploded perspective view of the receptacle connector of FIG. 12(B)
Figure 14B:
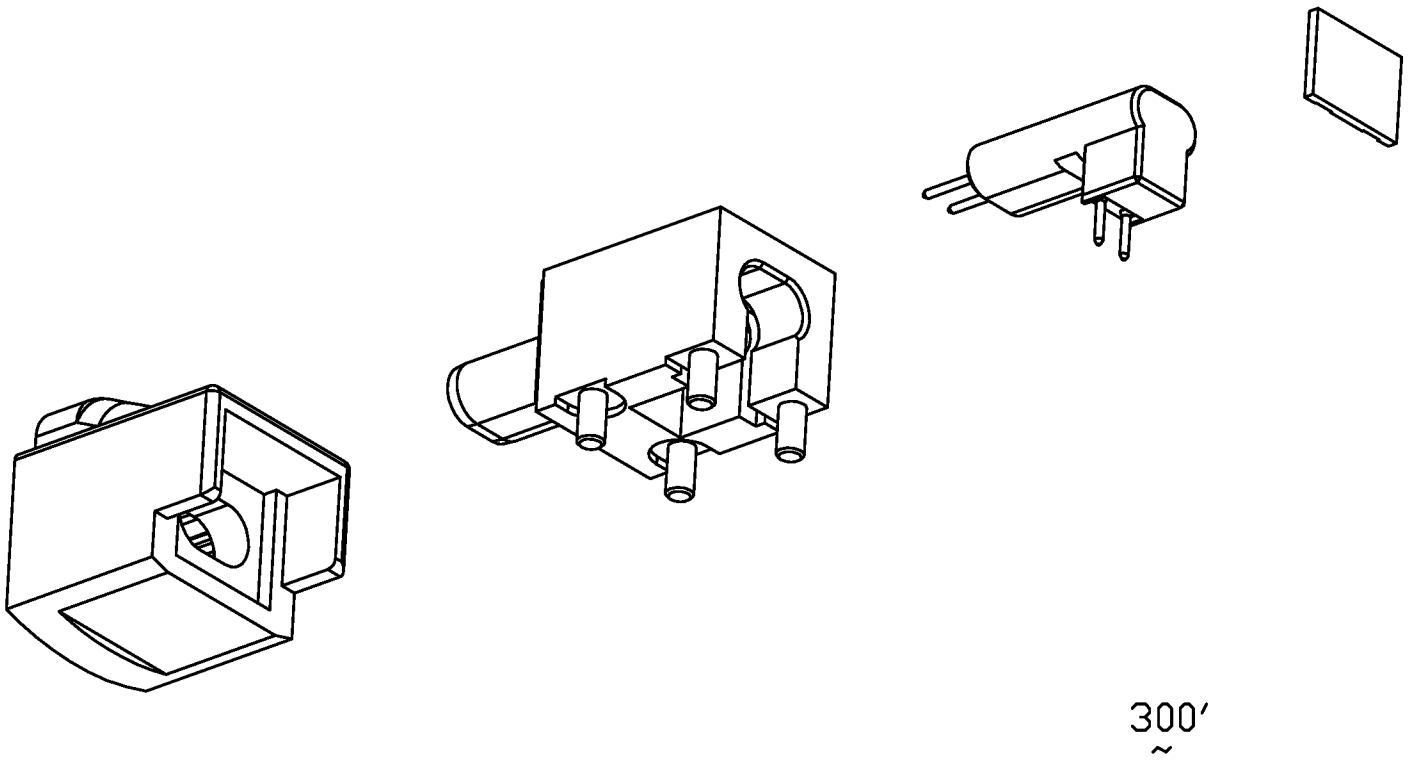
FIG. 14(B) is another exploded perspective view of the receptacle connector of FIG. 14(A)
Figure 15A:
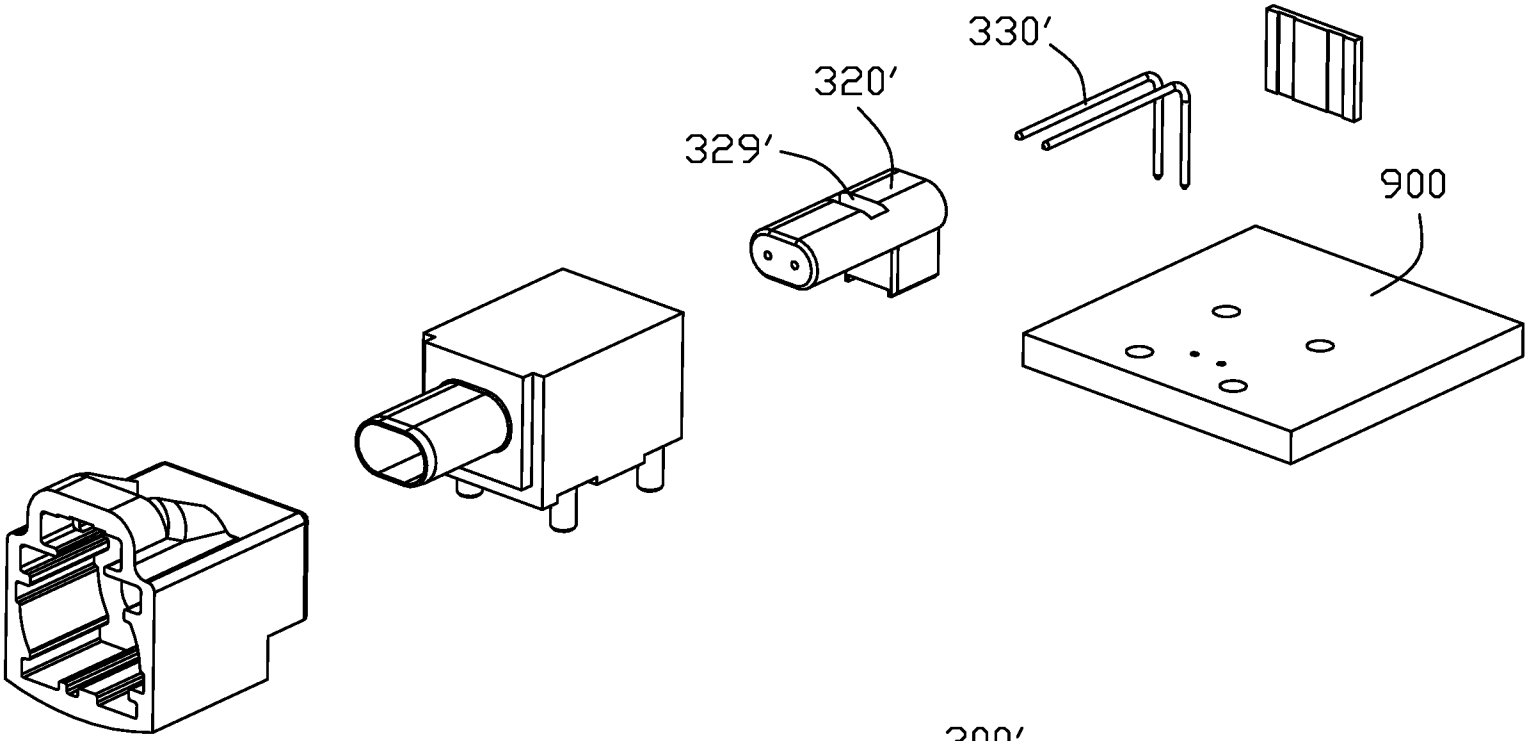
FIG. 15(A) is a further exploded perspective view of the receptacle connector of FIG. 13(A)
Figure 15B:
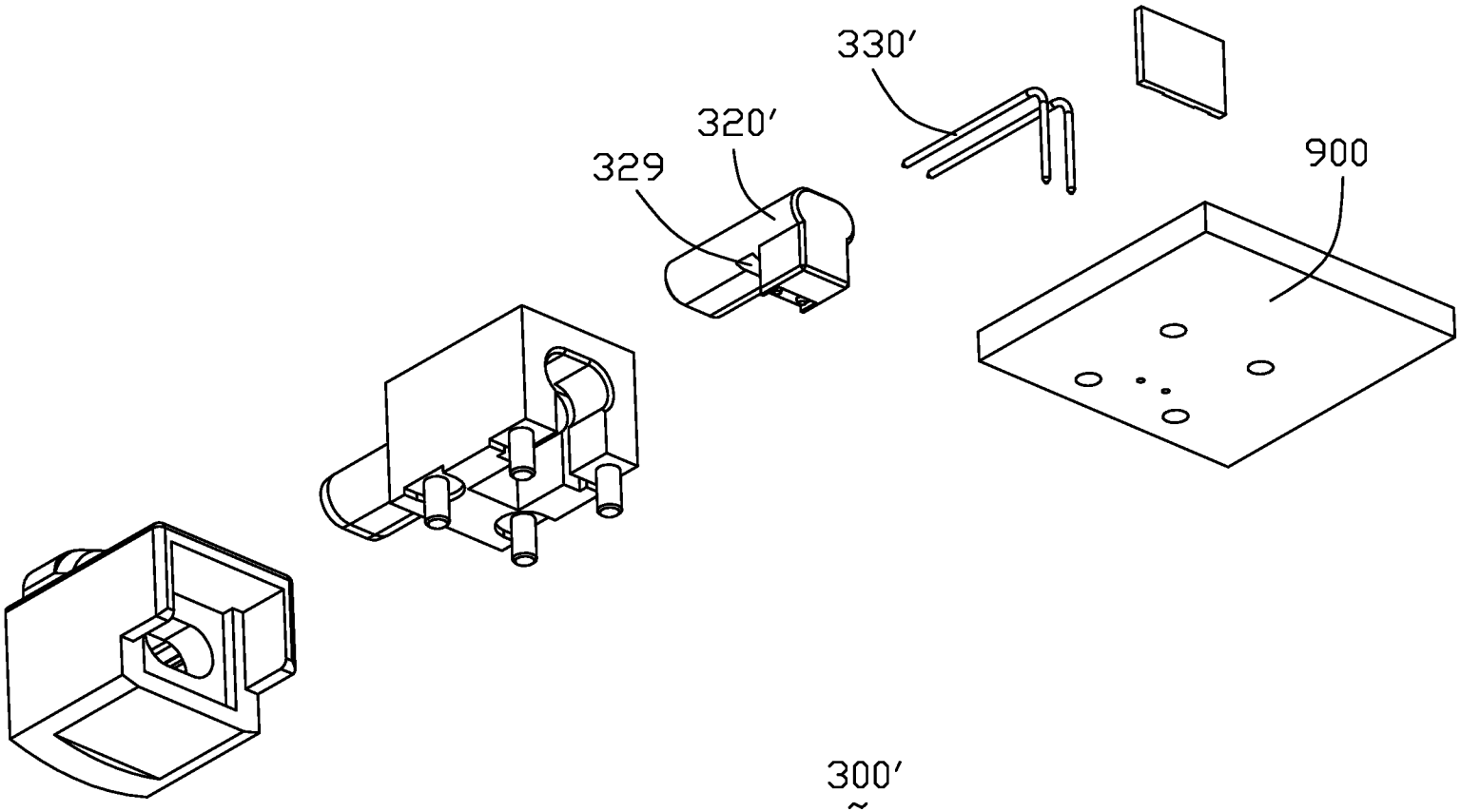
FIG. 15(B) is another exploded perspective view of the receptacle connector of FIG. 15(A)
Figure 16A:
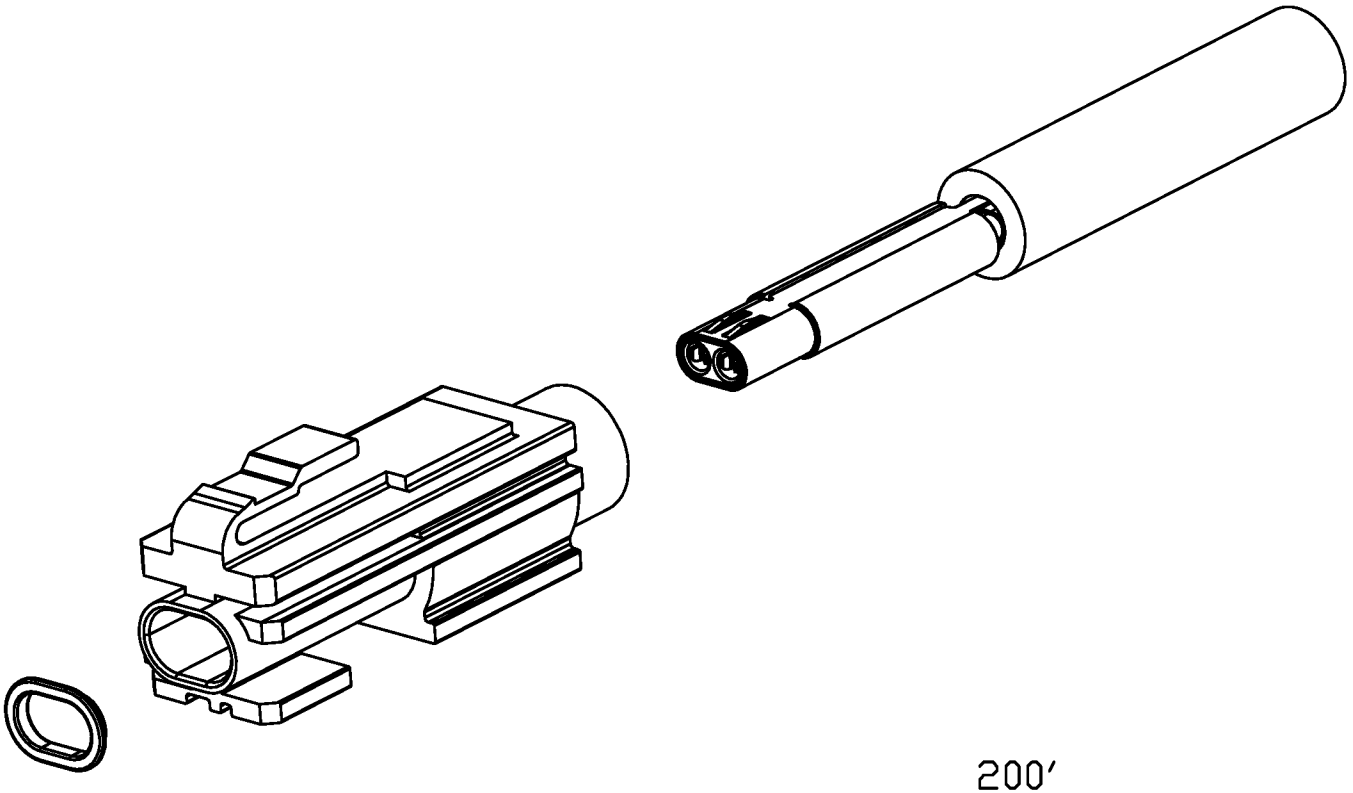
FIG. 16(A) is an exploded perspective view of the cable connector of the electrical connector assembly of FIG. 10(A)
Figure 16B:
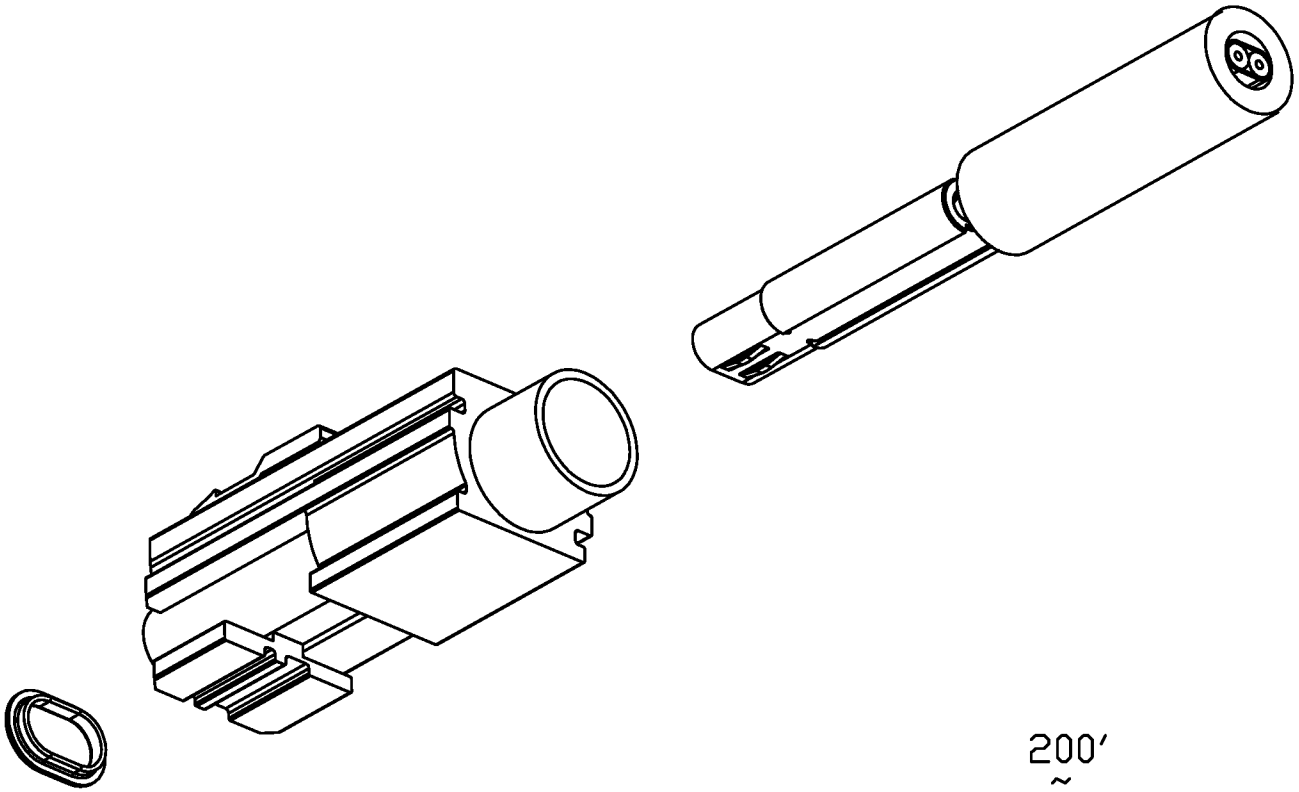
FIG. 16(B) is another exploded perspective view of the cable connector of FIG. 16(A)
Figure 17A:
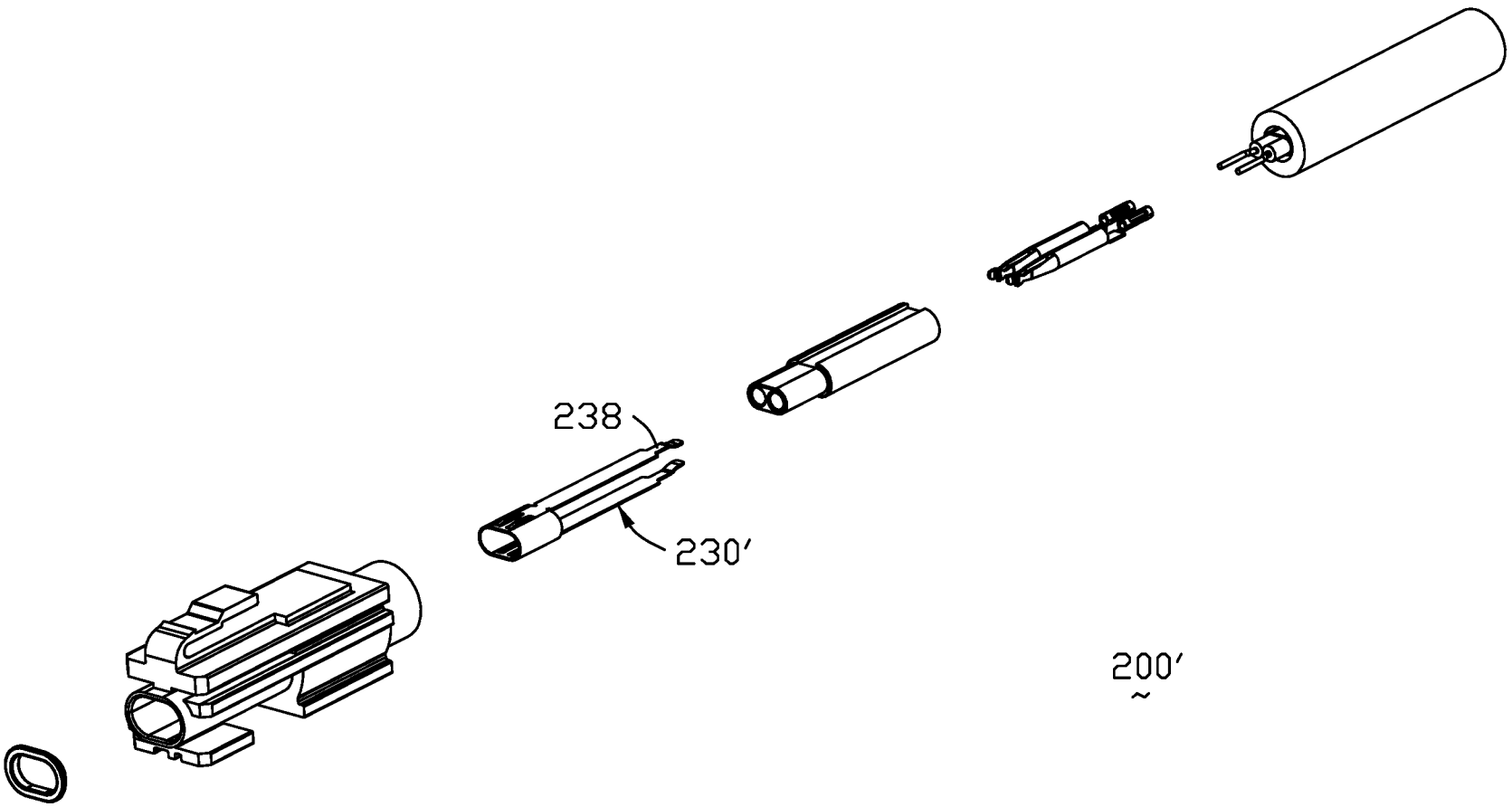
FIG. 17(A) is a further exploded perspective view of the cable connector of FIG. 16(A)
Figure 17B:
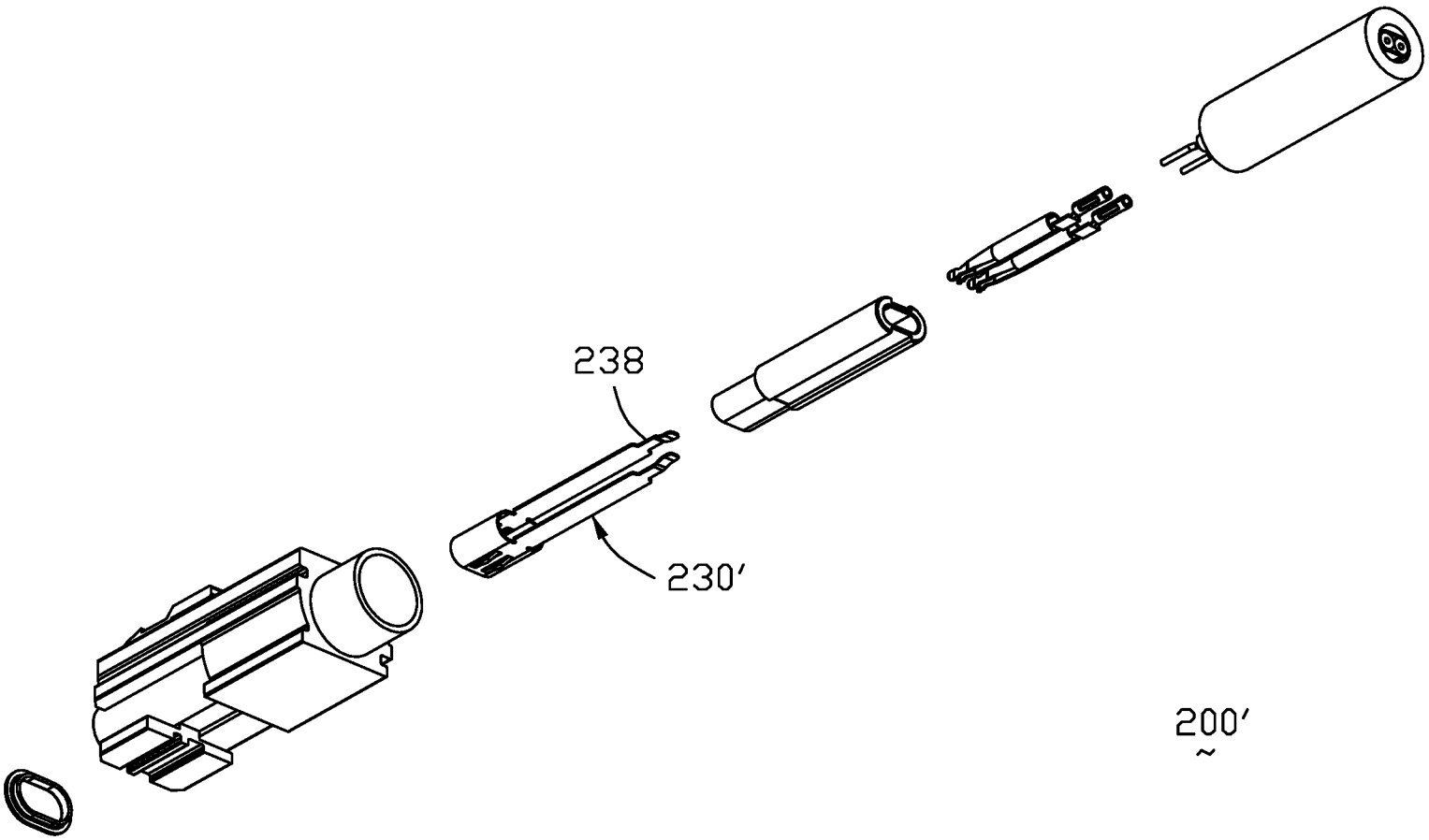
FIG. 17(B) is another exploded perspective view of the cable connector of FIG. 17(A)
Figure 18A:
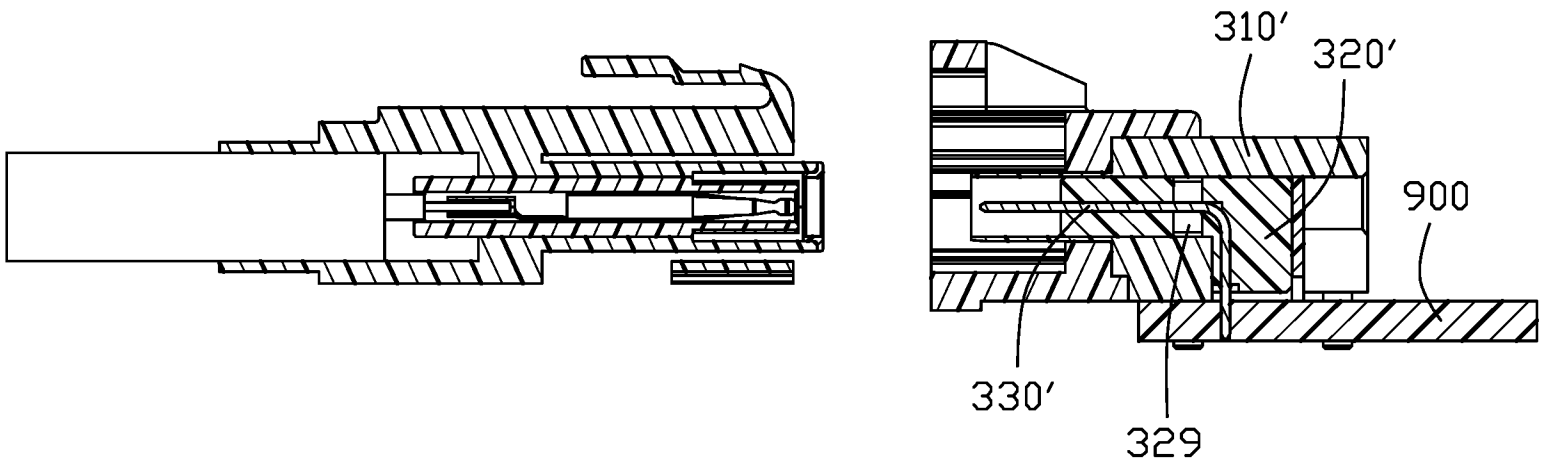
FIG. 18(A) is a cross-sectional view of the electrical connector assembly taken along lines 18A-18A in FIG. 10(A)
Figure 18B:
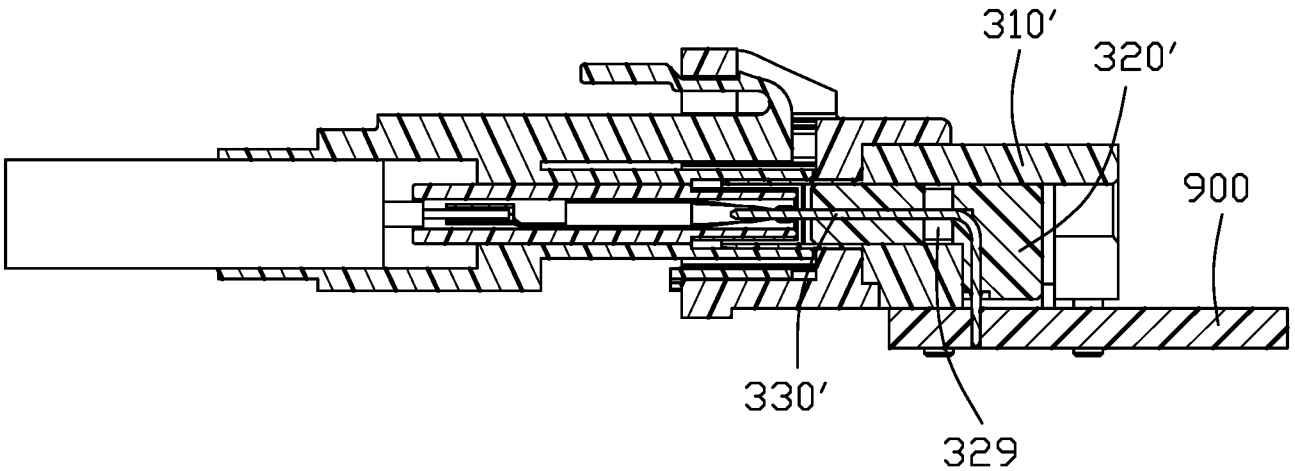
FIG. 18(B) is a cross-sectional view of the electrical connector assembly taken along lines 18B-18*b* in FIG. 9(A)
Figure 19:
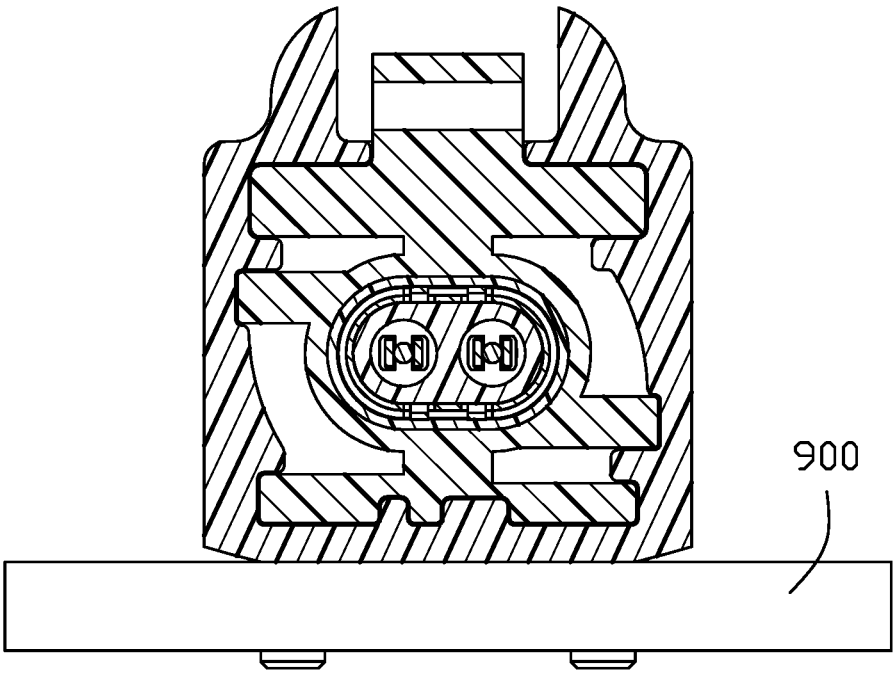
FIG. 19 is a cross-sectional view of the electrical connector assembly taken along lines 19-19 in FIG. 9(A)

During mating, the mating portion 212 of the cable connector 200 is received within the receiving cavity 352, and the tubular mating section 314 is disposed in the circumferential gap G as labeled in FIG. 6(A) formed the capsular tube 211 and the tubular section 232 wherein the contacts 330 are clamped by the corresponding contacts 240. The deflectable latch 218 is locked with the locking shoulder 359. As best shown in FIG. 8, the receiving cavity 352 defines several horizontal recesses extending along the front and rear direction, the bars 213, 217, 2151, 2152 are inserted in corresponding recesses to achieve a snugly engagement with the inside of the receiving cavity and some spaces are remained to air flow.

FIGS. 9(A)-19 discloses another embodiment of the electrical connector assembly 100' similar to the previous embodiment except two differences, including the cable connector 200' and the receptacle connector 300' mounted upon a printed circuit board 900. The first difference refers to the EMI shell 230' of the cable connector 200', as shown in FIGS. 17(A) and 17(B), of which the rear end 238 further extends to contact a braiding layer (not shown) of the cable 250'. The second difference refers to the insulative housing 320', as shown in FIGS. 15(A) and 15(B), which further includes a through hole 329 extending therethrough in the vertical direction for holding the contacts 330' in position during insert-molding the contacts 330' in the insulative housing 320'. Notably, the through hole 329 is hidden in the metallic housing 310' in the receptacle connector 300'.

While a preferred embodiment in accordance with the present disclosure has been shown and described, equivalent modifications and changes known to persons skilled in the art according to the spirit of the present disclosure are considered within the scope of the present disclosure as described in the appended claims.

What is claimed is:

1. An electrical connector assembly comprising:

a cable connector comprising:

an insulative main housing having a front mating portion defining a capsular tube, and a rear holding portion with a sleeve;

an insulative contact housing with a pair of cable contacts received therein and a metallic EMI shell covering an exterior of the contact housing;

a cable mechanically and electrically connected to the cable contact;

the contact housing with the associated cable contacts and the EMI shell inserted into the insulative main housing from a rear side of the insulative main housing wherein the contact housing is received within the front mating portion and the cable is received within the sleeve;

a receptacle connector comprising:

a metallic housing defining a tubular mating section;

an insulative housing received within the metallic housing;

a pair of receptacle contacts insert-molded within the insulative housing; and an insulative cover enclosing the metallic housing; wherein the tubular mating section of the metallic housing of the receptacle connector is received within a circumferential gap form between the insulative main housing and the EMI shell of the cable connector.

2. The electrical connector assembly as claimed in claim 1, wherein the insulative housing of the receptacle connector forms a hole extending therethrough in a vertical direction for holding the corresponding receptacle contacts during a insert-molding process while said hole is hidden within the metallic housing.

3. The electrical connector assembly as claimed in claim 1, wherein an insulative gasket is optionally applied upon a front end face of the capsular tube of the cable connector.

4. A cable connector comprising:

an insulative main housing having a front mating portion defining a capsular tube, and a rear holding portion with a sleeve;

an insulative contact housing with a pair of cable contacts received therein and a metallic shell covering an exterior of the contact housing, received in the main housing;

a cable mechanically and electrically connected to the cable contact, and received in the sleeve;

wherein the metallic shell comprises a tubular section and two plate sections extending rearwards from the tubular section thereof, the tubular section of metallic shell set on a front portion of the contact housing and the plate sections are received corresponding channels defined on the contact housing;

wherein a circumferential gap is defined between the tubular section of the metallic shell and the capsular section of the main housing.

5. The cable connector as claimed in claim 4, wherein the tubular section of the metallic shell defines a spring tang at each of upper and lower surfaces thereof, the spring tangs protrudes into the circumferential gap.

6. The cable connector as claimed in claim 4, wherein an insulative gasket is optionally applied upon a front end face of the capsular tube of main housing.

7. The cable connector as claimed in claim 4, wherein each cable contact comprises a pair of resilient mating sections and a connecting section crimped a conductive wire of the cable.

8. The cable connector as claimed in claim 4, wherein the front mating portion further comprises a top bar above the capsular tube, a bottom bar below the capsular tube and a lower side bar and a upper side bar extending from opposite exterior sides of the capsular tube.

9. The cable connector as claimed in claim 4, wherein the plate sections extend and contact a braiding layer of the cable.

10. A receptacle connector comprising:

a metallic housing comprising a front tubular mating section and a rear main body, defining a passageway extending through a rear side and in compliant alignment with the tubular mating section along a front-to-back direction and a cavity communicatively below the passageway in a vertical direction;

an insulative contact housing comprising a main portion received within the passageway and a stand below the main portion and received within the cavity;

a pair of receptacle contacts retained in the contact housing and comprising front mating sections beyond a front end of the main portion and solder sections below the stand, the front mating sections being exposed in the front tubular mating section of the metallic housing;

an insulative cover enclosing the metallic housing;

wherein the pair of receptacle contacts are insert-molded within the contact housing.

11. The receptacle connector as claimed in claim 10, wherein a groove extends from a bottom side of the main body and is terminated without through an upper side of the main body in a vertical direction, a retainer is upwardly inserted into the groove to prohibit backward movement of the insulative housing relative to the metallic housing.

* * * * *